US011828038B2

(12) United States Patent
Miller et al.

(10) Patent No.: US 11,828,038 B2
(45) Date of Patent: Nov. 28, 2023

(54) PILE CONNECTION FOR HORIZONTALLY FIXING AN ELONGATED BEAM FOR A FOUNDATION SUPPORT SYSTEM

(71) Applicants: Dale Clayton Miller, Youngsville, NC (US); Julian Young, Medford, OR (US)

(72) Inventors: Dale Clayton Miller, Youngsville, NC (US); Julian Young, Medford, OR (US)

( * ) Notice: Subject to any disclaimer, the term of this patent is extended or adjusted under 35 U.S.C. 154(b) by 103 days.

(21) Appl. No.: 17/370,280

(22) Filed: Jul. 8, 2021

(65) Prior Publication Data

US 2022/0010516 A1 Jan. 13, 2022

Related U.S. Application Data

(60) Provisional application No. 63/050,493, filed on Jul. 10, 2020.

(51) Int. Cl.
*E02D 5/52* (2006.01)
*E02D 5/54* (2006.01)

(52) U.S. Cl.
CPC ..... *E02D 5/526* (2013.01); *E02D 5/54* (2013.01); *E02D 2600/20* (2013.01)

(58) Field of Classification Search
CPC ..... E02D 5/526; E02D 5/54; E02D 2600/20
See application file for complete search history.

(56) References Cited

U.S. PATENT DOCUMENTS 2,001,719 A 5/1935 Greene
2,964,145 A 12/1960 Clatfelter
3,591,113 A 7/1971 Foster, Jr.
3,775,918 A 12/1973 Johnson
3,964,404 A 6/1976 Mueller et al.
4,012,883 A 3/1977 Muller
4,090,364 A 5/1978 Muller
4,189,125 A 2/1980 Little
4,295,308 A 10/1981 Korfanta
4,378,179 A 3/1983 Hasle
4,402,166 A 9/1983 Wortham, Jr.
(Continued)

FOREIGN PATENT DOCUMENTS

DE 823336 C 11/1952
DE 102009037175 A1 2/2011
(Continued)

OTHER PUBLICATIONS

Author Unknown, "Foundation Brackets: A Stronger Foundation," Product Page, magnumpiering.com/product-category/foundation-brackets/, accessed Nov. 11, 2020, Magnum Piering, 13 pages.
(Continued)

*Primary Examiner* — Kyle Armstrong
(74) *Attorney, Agent, or Firm* — Withrow & Terranova, P.L.L.C.

(57) ABSTRACT

Disclosed is a pile connection for horizontally fixing an elongated beam for a foundation support system. In particular, disclosed is a pile connection including at least one pile sleeve and at least one coupling attaching the at least one pile sleeve to an elongated beam such that a pile within the at least one pile sleeve extends between a top and bottom of the beam. Such a configuration provides a cost-effective, modular, and scalable system that is easily installed and adaptable to a variety of different terrains.

24 Claims, 18 Drawing Sheets

(56) References Cited

U.S. PATENT DOCUMENTS

| | | | |
|---|---|---|---|
| 4,431,347 | A | 2/1984 | Gillen, Jr. |
| 4,899,497 | A | 2/1990 | Madl, Jr. |
| 5,039,256 | A | 8/1991 | Gagliano |
| 5,065,975 | A | 11/1991 | Giles |
| 5,104,074 | A | 4/1992 | Malloy |
| D335,435 | S | 5/1993 | Lawson |
| 5,395,184 | A | 3/1995 | Gagliano |
| 5,501,550 | A | 3/1996 | Calabrese |
| 5,515,656 | A | 5/1996 | Mihalich |
| 5,791,635 | A | 8/1998 | Hull et al. |
| 5,873,679 | A | 2/1999 | Cusimano |
| D409,764 | S | 5/1999 | Laga |
| 5,961,093 | A | 10/1999 | Jones et al. |
| D423,686 | S | 4/2000 | Swain |
| D437,544 | S | 2/2001 | Oliver et al. |
| 6,298,618 | B1 | 10/2001 | Lawson |
| 6,368,021 | B1 | 4/2002 | Strong et al. |
| D495,426 | S | 8/2004 | Yamaoka |
| 6,979,151 | B1 | 12/2005 | Bourgeo |
| 7,610,733 | B2 | 11/2009 | Rizzotto |
| 7,681,373 | B2 | 3/2010 | Kariakin |
| D622,868 | S | 8/2010 | Bajrami |
| D622,869 | S | 8/2010 | Bajrami |
| D666,473 | S | 9/2012 | Despotellis |
| D666,474 | S | 9/2012 | Despotellis |
| D666,895 | S | 9/2012 | Despotellis |
| 8,561,361 | B2 | 10/2013 | Bauletti |
| 8,844,209 | B1 | 9/2014 | Oliver et al. |
| 9,109,355 | B1 | 8/2015 | Strauch |
| D757,959 | S | 5/2016 | Aoi et al. |
| 9,499,998 | B2 | 11/2016 | Bardelli et al. |
| 9,850,638 | B2 | 12/2017 | Despotellis |
| 10,526,758 | B1 | 1/2020 | Martin et al. |
| D901,282 | S | 11/2020 | Miller et al. |
| D953,843 | S | 6/2022 | Miller et al. |
| 2003/0085482 | A1 | 5/2003 | Sincock et al. |
| 2003/0143036 | A1 | 7/2003 | Larsen, Jr. |
| 2004/0149796 | A1 | 8/2004 | Cohen |
| 2005/0081459 | A1 | 4/2005 | Moroschan |
| 2006/0013656 | A1 | 1/2006 | Blum |
| 2006/0275085 | A1 | 12/2006 | Ong |
| 2007/0158526 | A1 | 7/2007 | Platt |
| 2009/0052994 | A1 | 2/2009 | Lawler |
| 2009/0245977 | A1 | 10/2009 | Edelson et al. |
| 2010/0290843 | A1 | 11/2010 | Irvine et al. |
| 2010/0307073 | A1 | 12/2010 | Oliver et al. |
| 2011/0158752 | A1 | 6/2011 | Hitchin |
| 2013/0086974 | A1 | 4/2013 | Rausche |
| 2014/0311083 | A1 | 10/2014 | Madril |
| 2015/0071712 | A1 | 3/2015 | Kemp et al. |
| 2015/0211200 | A1 | 7/2015 | Nishioka et al. |
| 2015/0292228 | A1 | 10/2015 | Bardelli et al. |
| 2016/0186403 | A1 | 6/2016 | Tomchesson et al. |
| 2017/0101760 | A1 | 4/2017 | Seay |
| 2018/0106010 | A1 | 4/2018 | Despotellis |
| 2018/0106063 | A1 | 4/2018 | De Kleine |
| 2021/0172139 | A1 | 6/2021 | Duncan et al. |
| 2022/0186454 | A1 | 6/2022 | Miller et al. |

FOREIGN PATENT DOCUMENTS

| | | | |
|---|---|---|---|
| EP | 1205605 | A2 | 5/2002 |
| EP | 2360331 | A1 | 8/2011 |
| FR | 2829777 | A1 | 3/2003 |
| JP | 2017186788 | A | 10/2017 |
| WO | 2020080964 | A1 | 4/2020 |

OTHER PUBLICATIONS

Mitchell, Chris, "J & J Nevada—Seismic Retrofit & Tenant Improvement with Micropiles," versagrade.com/2016/02/03/j-j-nevada-seismic-retrofit-tenant-improvement-with-micro-piles/, Feb. 3, 2016, VersaGrade, Inc., Reno, Nevada, 4 pages.

International Search Report and Written Opinion for International Patent Application No. PCT/US21/62527, dated Mar. 22, 2022, 10 pages.

Non-Final Office Action for U.S. Appl. No. 17/546,155, dated Nov. 4, 2022, 16 pages.

Quayle Action for U.S. Appl. No. 29/706,954, mailed Nov. 26, 2021, 4 pages.

Bruce et al. "Micropiles: the state of practice Part 1: Characteristics, definitions and classifications" Ground Improvement, vol. 1, No. 1, 1997, pp. 25-35.

G., Jared "Commercial Generator Buyer's Guide," Electric Generators Direct, 2020, 5 pages.

INDAPTER "Type GF Grate-Fast" http://www.lindapter.com, 2020, 2 pages.

Mason et al. "Lizzi's Structural System Retrofit with Reticulated Internal Reinforcement Method" Transportation Research Record, Paper No. 01-2861, 2001, pp. 107-114.

Mehdizadeh et al. "Static Load Testing of Concrete Free Reticulated Micropiles System" 5th International Conference on Geotechnical and Geophysical Site Characterization, 2016, 6 pages.

Sadek et al. "Influence of micropile inclination on the performance of a micropile network" Ground Improvement, vol. 10, No. 4, 2006, pp. 165-172.

Sunbelt "Temporary Bridging System" https://www.sunbeltrentals.com/equipment/detail/1715/2380001/temporary-bridging-system/, 2020, 3 pages.

Tsukada et al. "Mechanism of Bearing Capacity of Spread Footings Reinforced With Microphiles" Soils and Foundations, vol. 46, No. 3, 2006, pp. 367-376.

Woodstock Power "What to Know Before Installing a Backup Commercial Generator" https://woodstockpower.com, 2020, 7 pages.

You et al. "Behavior of Micropile Foundations Under Inclined Loads in Laboratory Tests" Lowland Technology International, vol. 5, No. 2, 2003, pp. 16-26.

Quayle Action for U.S. Appl. No. 29/706,951, mailed Jul. 7, 2020, 6 pages.

Notice of Allowance for U.S. Appl. No. 17/546,155, dated Jun. 20, 2023, 8 pages.

Final Office Action for U.S. Appl. No. 17/546,155, dated Apr. 6, 2023, 9 pages.

Office Action for Canadian Patent Application No. 3202201, dated Sep. 8, 2023, 5 pages.

PILE CONNECTION FOR HORIZONTALLY FIXING AN ELONGATED BEAM FOR A FOUNDATION SUPPORT SYSTEM

RELATED APPLICATIONS

The present application claims priority to U.S. Provisional Patent Application Ser. No. 63/050,493 entitled "PILE CONNECTION FOR HORIZONTALLY FIXING AN ELONGATED BEAM FOR A FOUNDATION SUPPORT SYSTEM," filed on Jul. 10, 2020, which is incorporated hereby by reference in its entirety.

FIELD OF THE DISCLOSURE

The disclosure relates to a pile connection, and more particularly, to a pile connection for horizontally fixing an elongated beam for a foundation support system.

BACKGROUND

Concrete foundations are frequently used in a wide variety of construction projects. However, use of concrete foundations may be difficult or suboptimal in certain applications or circumstances. For example, concrete may not be preferred or even possible in remote locations, on steep terrain, and/or in time-sensitive applications (e.g., due to concrete curing time, weather interruptions, etc.).

Piles provide an alternative to concrete foundations, such as where heavy equipment is inaccessible or to minimize landscape impact. However, piles often require a plate or cap, such as to vertically mount a structural beam to the ground. Such a configuration may not provide sufficient modularity or scalability to accommodate a variety of designs and construction needs.

No admission is made that any reference cited herein constitutes prior art. Applicant expressly reserves the right to challenge the accuracy and pertinency of any cited documents.

SUMMARY

Disclosed is a pile connection for horizontally fixing an elongated beam for a foundation support system. In particular, disclosed is a pile connection including at least one pile sleeve and at least one coupling attaching the at least one pile sleeve to an elongated beam such that a pile within the at least one pile sleeve extends between a top and bottom of the beam. Such a configuration provides a cost-effective, modular, and scalable system that is easily installed and adaptable to a variety of different terrains.

One embodiment is directed to a pile connection for horizontally fixing an elongated beam to a ground. The pile connection includes a first pile sleeve configured to receive a first pile, and at least one coupling configured to attach the first pile sleeve to an elongated beam extending along a beam axis and having a first side, a second side, a top, and a bottom surrounding the beam axis. The at least one coupling is configured to attach the first pile sleeve to the elongated beam at the first side of the elongated beam such that the first pile within the first pile sleeve extends between the top and the bottom of the elongated beam.

Another embodiment is directed to a foundation support system, comprising at least one elongated beam, at least one pile connection, and a first pile. The at least one elongated beam extends along a beam axis and has a first side, a second side, a top, and a bottom surrounding the beam axis. The at least one pile connection is attached to the at least one elongated beam. The at least one pile connection includes a first pile sleeve, at least one coupling configured to attach the first pile sleeve to the elongated beam, and a first pile positioned within the first pile sleeve. The at least one coupling attaches the first pile sleeve to the elongated beam at the first side of the elongated beam such that the first pile within the first pile sleeve extends between the top and the bottom of the elongated beam.

Another embodiment is directed to a method for forming a foundation support system. The method includes positioning an elongated beam horizontally to a ground, the elongated beam extending along a beam axis, and having a first side, a second side, a top, and a bottom surrounding the beam axis. The method further includes attaching a first pile connection to the elongated beam by at least one coupling to attach a first pile sleeve on a side of the elongated beam. The method further includes inserting a first pile into the first pile sleeve and driving the first pile into the ground such that the first pile within the first pile sleeve extends vertically into the ground between the top and the bottom of the elongated beam to horizontally fix the elongated beam to the ground.

Additional features and advantages will be set forth in the detailed description which follows, and in part, will be readily apparent to those skilled in the art from that description or recognized by practicing the embodiments as described herein, including the detailed description which follows, the claims, as well as the appended drawings.

It is to be understood that both the foregoing general description and the following detailed description are merely exemplary and are intended to provide an overview or framework to understanding the nature and character of the claims. The accompanying drawings are included to provide a further understanding and are incorporated in and constitute a part of this specification. The drawings illustrate one or more embodiment(s), and together with the description, serve to explain principles and operation of the various embodiments.

DETAILED DESCRIPTION

Figure 1A:
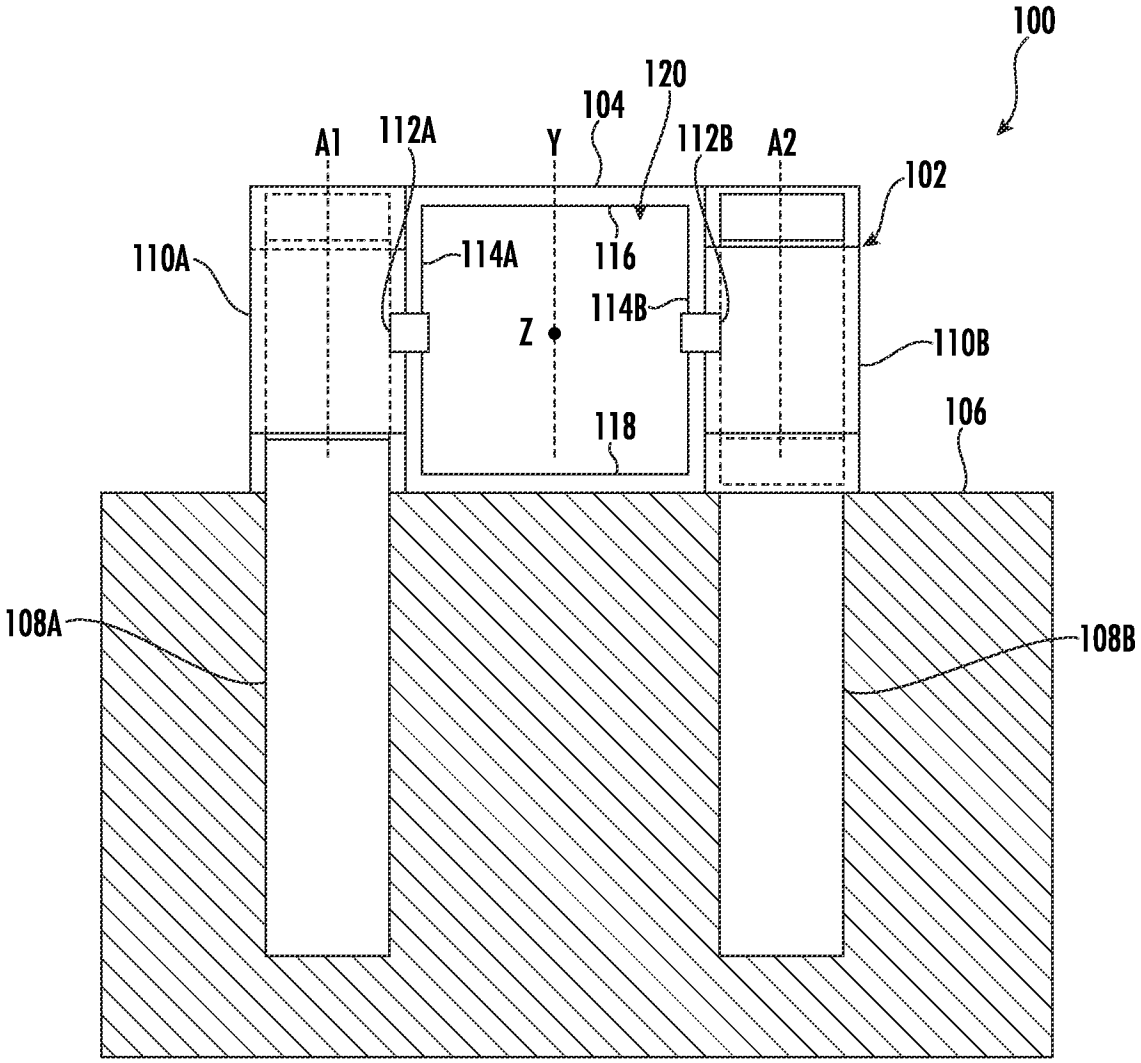
FIG. 1A is a front view of a foundation support system including a pile connection horizontally fixing an elongated beam to the ground.

Reference will now be made in detail to the presently preferred embodiments, examples of which are illustrated in the accompanying drawings. Whenever possible, the same reference numerals will be used throughout the drawings to refer to the same or like parts.

Terms such as "left," "right," "top," "bottom," "front," "back," "horizontal," "parallel," "perpendicular," "vertical," "lateral," "coplanar," and similar terms are used for the convenience of describing the attached figures and are not intended to limit this description. For example, terms such as "left side" and "right side" are used with specific reference to the drawings as illustrated, and the embodiments may be in other orientations in use. Further, as used herein, terms such as "horizontal," "parallel," "perpendicular," "vertical," "lateral," etc., include slight variations that may be present in working examples.

It will be understood that, although the terms first, second, etc., may be used herein to describe various elements, these elements should not be limited by these terms. These terms are only used to distinguish one element from another. For example, a first element could be termed a second element, and, similarly, a second element could be termed a first element without departing from the scope of the present disclosure. As used herein, the term "and/or" includes any and all combinations of one or more of the associated listed items.

It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Disclosed is a pile connection for horizontally fixing an elongated beam for a foundation support system. In certain embodiments, the pile connection and/or foundation support system requires minimal hand-held equipment, minimal site prep, and/or no excavation or removal of excavated soil. In certain embodiments, the pile connection and/or foundation support system is adaptable to any terrain and applicable in penetrable soils of sand, silt clay, fine gravel, etc. In certain embodiments, the pile connection and/or foundation support system is superior to helical piers due to increased stability from an interconnected system. In certain embodiments, the pile connection and/or foundation support system may be less expensive than deep concrete footers. In certain embodiments, upon termination of a project, all components are removable and structural members available for reuse. In other words, minimal effort may be used to return a site to its original condition. In certain embodiments, the pile connection and/or foundation support system can reduce design time, construction time, and/or total installation costs.

Figure 1B:
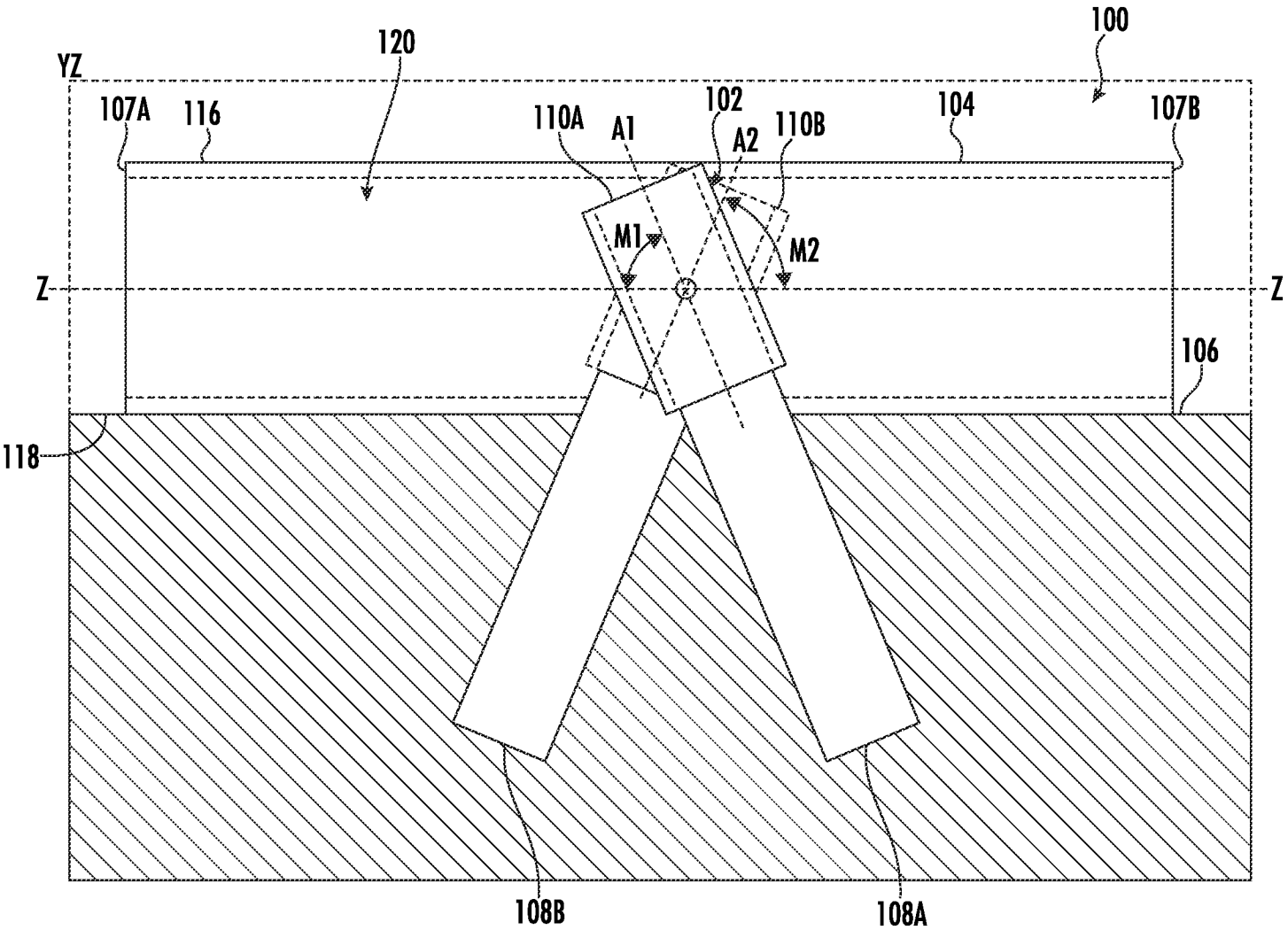
FIG. 1B is a side view of the foundation support system of FIG. 1A.
Figure 2A:
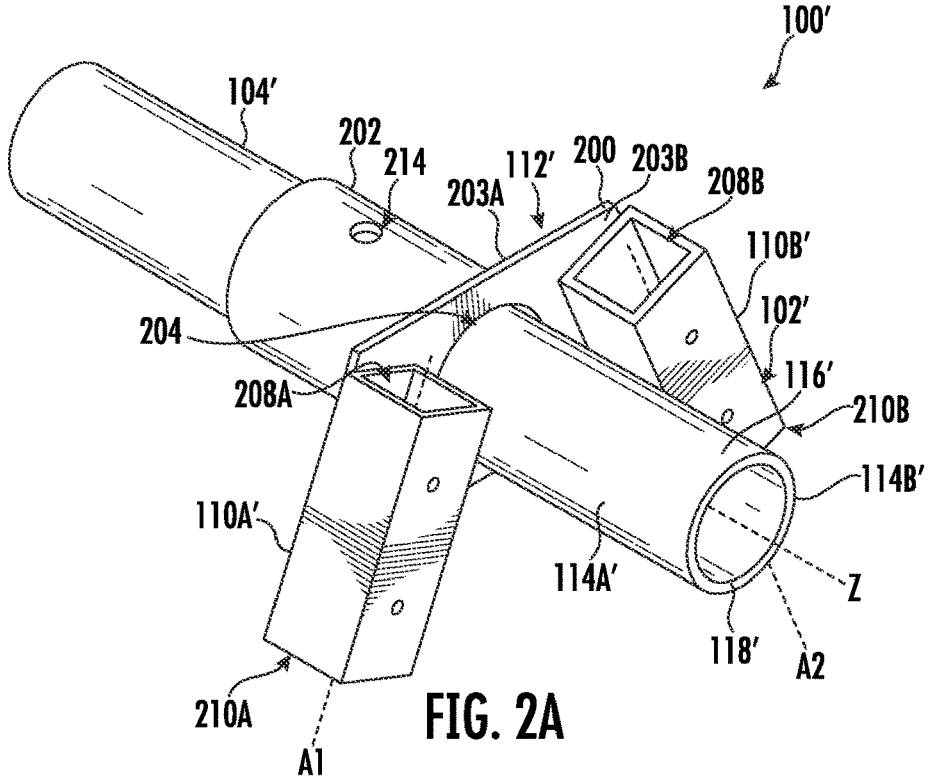
FIG. 2A is a perspective view of one embodiment of the pile connection of FIG. 1A for attachment to an elongated beam with a circular cross-section.
Figure 2B:
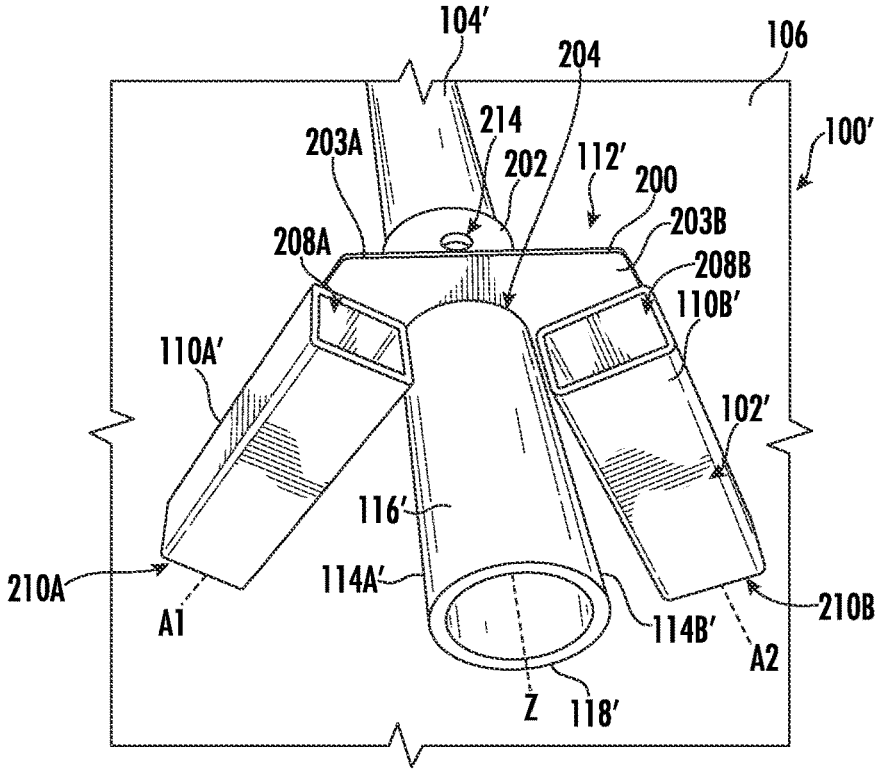
FIG. 2B is another perspective view of the pile connection of FIG. 2A.
Figure 2C:
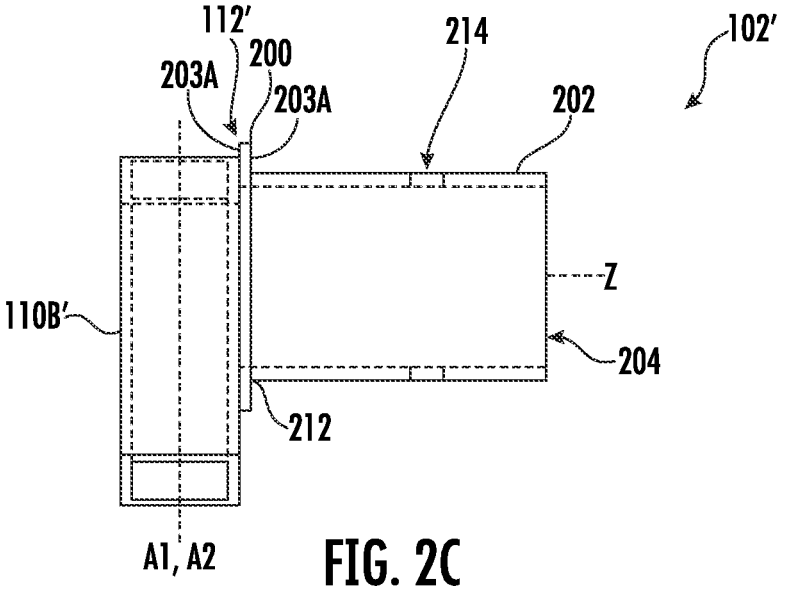
FIG. 2C is a side view of the pile connection of FIG. 2A.
Figure 2D:
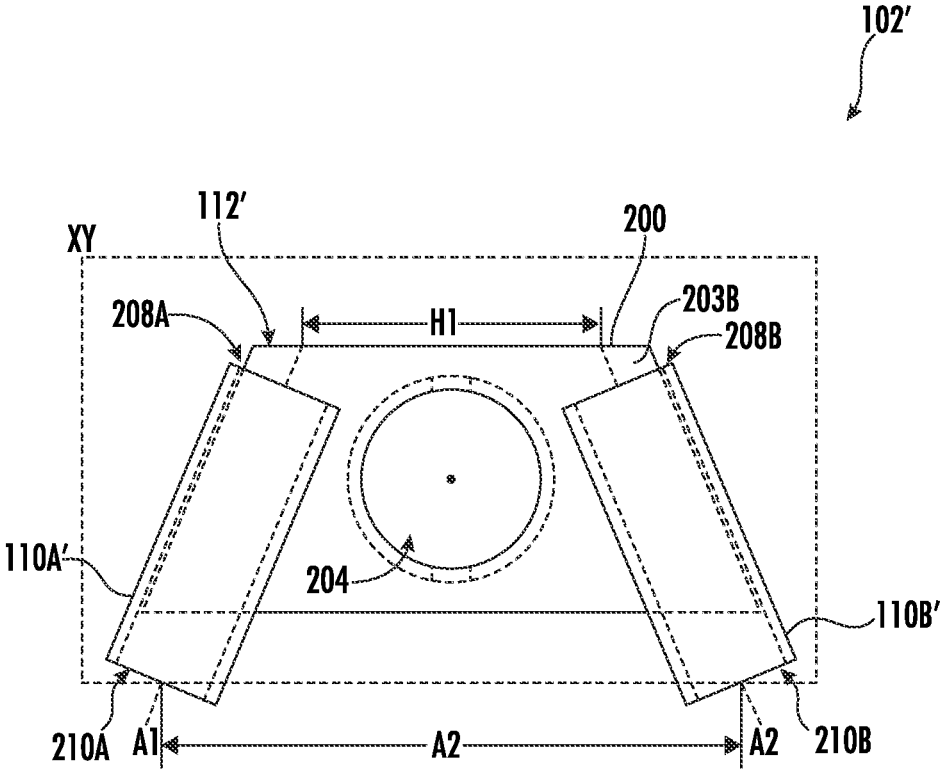
FIG. 2D is a front view of the pile connection of FIG. 2A.
Figure 2E:
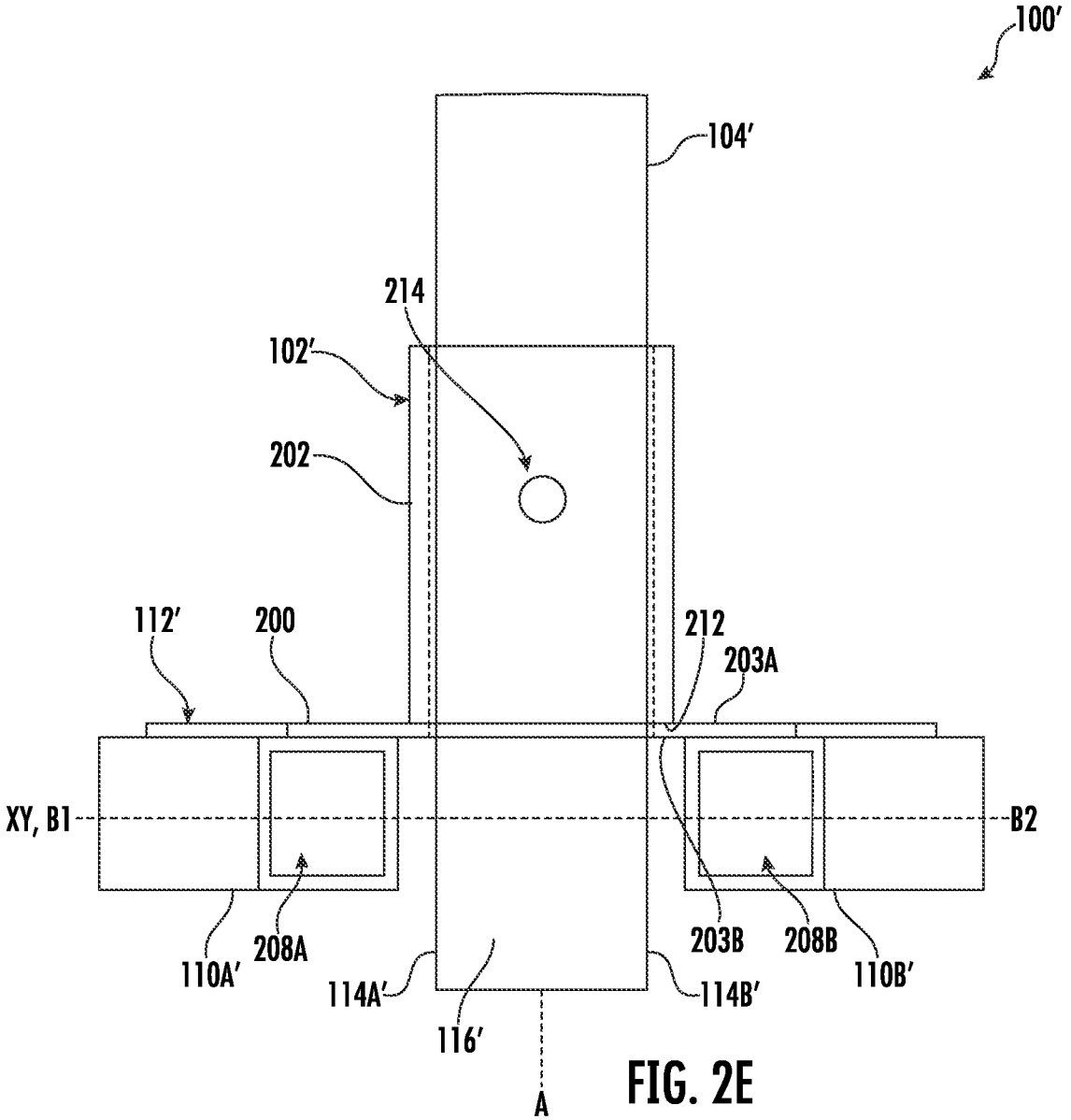
FIG. 2E is a top view of the pile connection of FIG. 2A.

FIGS. 1A-1B are views of a foundation support system 100, including a pile connection 102 horizontally fixing an elongated beam 104 to the ground 106. The elongated beam 104 may include a first end 107A and a second end 107B opposite the first end 107A with a cross-section extending between the first end 107A and the second end 107B along axis Z. In this way, the elongated beam 104 is positioned on the ground 106, so that axis Z is generally parallel to the ground 106. In other words, the first end 107A and the second end 107B are positioned generally parallel to the ground.

The foundation support system 100 includes at least one elongated beam 104, at least one pile connection 102, and at least one pile 108A, 108B. It is noted that any reference to "pile" is inclusive of "micropiles" (may also be referred to as minipiles, pin piles, need piles, root piles, etc.), which are deep foundation elements, typically with a diameter between 3-10 inches. Further, any reference to "pile" may instead be specific to "micropiles" instead.

The at least one pile connection 102 is attached to the elongated beam 104. The pile connection 102 includes a first pile sleeve 110A, a second pile sleeve 110B, and at least one coupling 112A, 112B configured to attach the first pile sleeve 110A and the second pile sleeve 110B to the elongated beam 104. In particular, a first coupling 112A attaches the first pile sleeve 110A to the elongated beam 104, and the second coupling 112B attaches the second pile sleeve 110B to the elongated beam 104. In certain embodiments, the at least one coupling 112A, 112B includes (or forms) a collar including at least one of a circular cross-section, a rectangular cross-section, or a square cross-section. In other words, in certain embodiments, the at least one coupling 112A, 112B is a single coupling that attaches the first and second pile sleeves 110A, 110B to the elongated beam 104.

The first pile sleeve 110A defines a first axis A1 and the second pile sleeve 110B defines a second axis A2. The first pile sleeve 110A is configured to receive a first pile 108A (along the first axis A1), and the second pile sleeve 110B is configured to receive a second pile 108B (along the second axis A2). The first pile 108A is positioned within the first pile sleeve 110A, and the second pile 108B is positioned within the second sleeve 110B. In certain embodiments, the pile connection 102 only includes one pile sleeve 110A, 110B. In certain embodiments, the pile connection 102 only includes two pile sleeves 110A, 110B. In certain embodiments, the first pile sleeve 110A and the second pile sleeve 110B are non-parallel to each other.

In certain embodiments, the at least one elongated beam 104 extends along a beam axis Z and has a first side 114A, a second side 114B, a top 116, and a bottom 118 surrounding the beam axis Z. In certain embodiments, the elongated beam 104 includes structural steel, such as circular tubing, rectangular tubing, square tubing, I-Beam, or W-Beam. In such a configuration, the first side 114A, second side 114B, top 116, and bottom 118 define a central channel 120. In certain embodiments, the elongated beam 104 includes timber (e.g., rectangular cross-section, square cross-section, etc.). In certain embodiments, the at least one pile connection 102 includes a plurality of pile connections 102 attached to a same one of the at least one elongated beams 104. In certain embodiments, the at least one elongated beam 102 includes a plurality of elongated beams 104, and the at least one pile connection 102 includes the plurality of pile connections 102 to fix the plurality of elongated beams 104 to the ground 106.

In certain embodiments, the axes A1, A2 of each of the pile sleeves 110A, 110B extends between the top 116 and the bottom 118 of the elongated beam 104. A plane YZ intersects axis Z, and/or the plane YZ further intersects the top 116 and the bottom 118. From the perspective of plane YZ, the axis A1 of the first pile sleeve 110A is at an angle M1 greater than 90°, and the axis B2 of the second pile sleeve 110B is at an angle M2 greater than 90°. In certain embodiments, the angle M1 and angle M2 are substantially the same.

In certain embodiments, a first coupling 112A attaches the first pile sleeve 110A to the elongated beam 104 at the first side 114A of the elongated beam 104 such that the first pile 108A within the first pile sleeve 110A extends between the top 116 and the bottom 118 of the elongated beam 104. A second coupling 112B attaches the second pile sleeve 110B to the elongated beam 104 at the second side 114B of the elongated beam 104 such that the second pile 108B within the second pile sleeve 110B extends between the top 116 and the bottom 118 of the elongated beam 104.

FIGS. 2A-2E are views of one embodiment of the pile connection 102 of FIG. 1A for attachment to an elongated beam 104' with a circular cross-section. In particular, a foundation support system 100' includes at least one pile connection 102' horizontally fixing the elongated beam 104' to the ground 106. The elongated beam 104' has a circular cross-section (although other cross-sections may be used).

The at least one pile connection 102' is attached to the at least one elongated beam 104'. The at least one pile connection 102' includes a first pile sleeve 110A', a second pile sleeve 110B', and at least one coupling 112' configured to attach the first pile sleeve 110A' and the second pile sleeve 110B' to the elongated beam 104'.

The coupling 112' attaches the first pile sleeve 110A' to the elongated beam 104' at a first side 114A' of the elongated beam 104' such that a first pile 108A (see FIGS. 1A-1B) within the first pile sleeve 110A' extends between a top 116' and a bottom 118' of the elongated beam 104'. The coupling 112' attaches the second pile sleeve 110B' to the elongated beam 104' at a second side 114B' of the elongated beam 104' such that a second pile 108B (see FIGS. 1A-1B) within the second pile sleeve 110B' extends between the top 116' and the bottom 118' of the elongated beam 104'. In particular, in certain embodiments, the coupling 112' includes a mounting plate 200 and/or a collar 202 perpendicularly attached to the mounting plate 200 at a first side 203A of the mounting plate 200. The first pile sleeve 110A' and the second pile sleeve 110B' are attached at a second side 203B of the mounting plate 200. The mounting plate 200 defines a central aperture 204. In certain embodiments, the first pile sleeve 110A' and the second pile sleeve 110B' each have a rectangular cross-section, such as to receive a pile 108A, 108B having a rectangular cross-section. It is noted that in this and any other embodiments described herein, the collar 202 and/or pile sleeves 110A', 110B' may have at least one of a circular cross-section, a rectangular cross-section, or a square cross-section.

In certain embodiments, the first pile sleeve 110A' and the second pile sleeve 110B' are attached to opposite sides 203A, 203B of the collar 202. The central aperture 204 of the mounting plate 200 is aligned with the collar 202. In certain embodiments, the collar 202 extends through the central aperture 204 of the mounting plate 200. In certain embodiments, the first pile sleeve 110A' and the second pile sleeve 110B' are aligned within a common plane XY. In certain embodiments, a top horizontal distance H1 between a top opening 208A of the first pile sleeve 110A' and a top opening 208B of the second pile sleeve 110B' is smaller than a bottom horizontal distance H2 between a bottom opening 210A of the first pile sleeve 110A' and a bottom opening 210B of the second pile sleeve 110B'. In certain embodiments, the first pile sleeve 110A' and the second pile sleeve 110B' are configured to extend from a top of the collar 202 to a bottom of the collar 202.

In certain embodiments, the mounting plate 200 is perpendicularly attached to an end 212 of the collar 202. The first pile sleeve 110A' and the second pile sleeve 110B' are attached to the mounting plate 200. In certain embodiments, the mounting plate 200 includes a trapezoidal shape. In certain embodiments, the collar 202 includes a cylindrical sidewall having a circular cross-section and defining a side hole 214 in the cylindrical sidewall for setting an orientation of the collar 202 about the elongated beam 104'. For example, in certain embodiments, the side hole 214 is threaded to receive a set screw or bolt therein to orient the pile connection 102' about the elongated beam 104' and/or along a length of the elongated beam 104'.

Figure 3A:
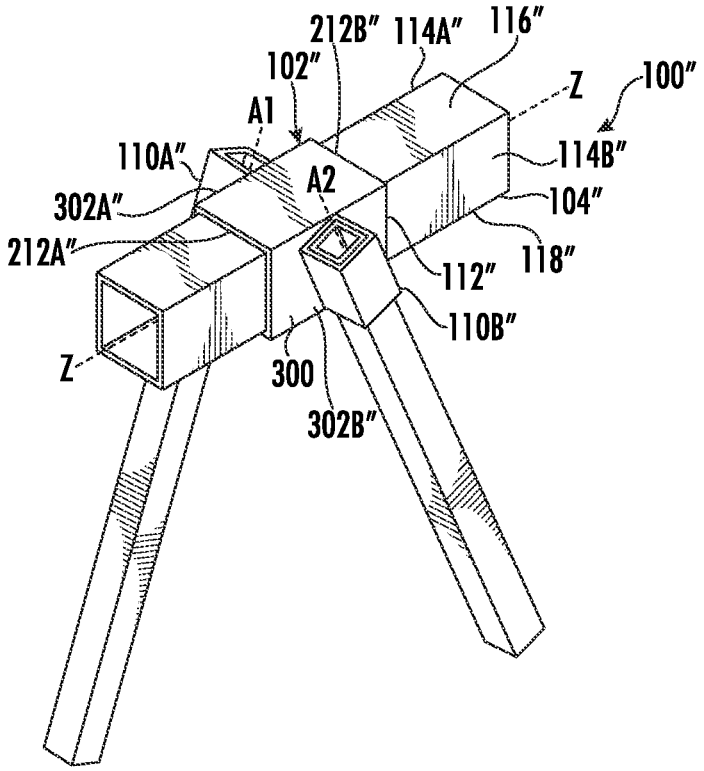
FIG. 3A is a perspective view of another embodiment of the pile connection of FIG. 1A for attachment to an elongated beam with a square cross-section.
Figure 3B:
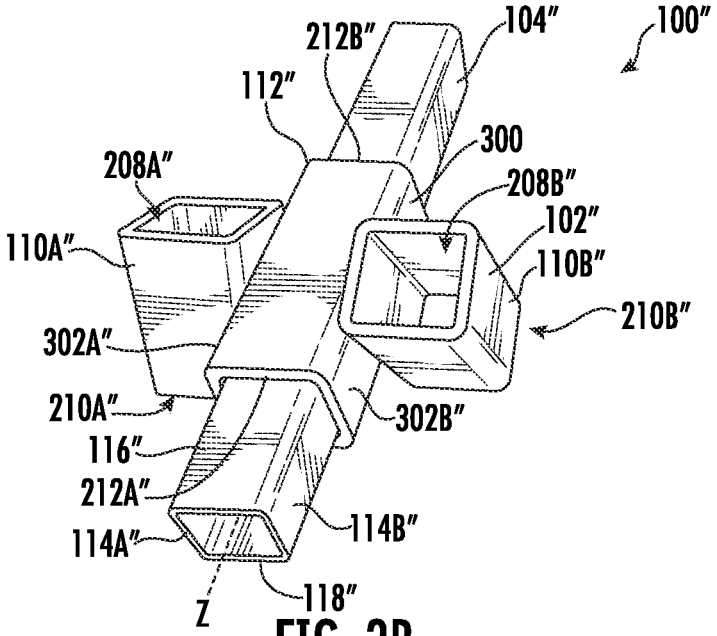
FIG. 3B is another perspective view of the pile connection of FIG. 3A.
Figure 3C:
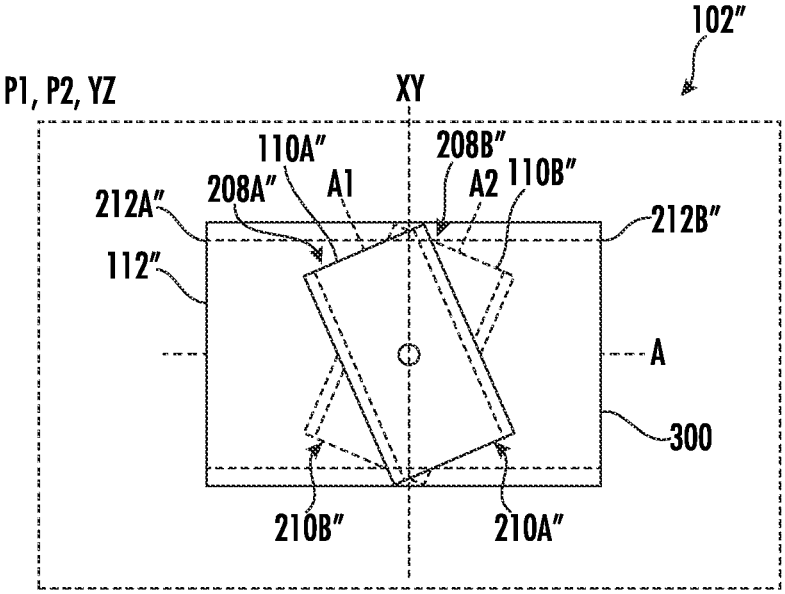
FIG. 3C is a side view of the pile connection of FIG. 3A.
Figure 3D:
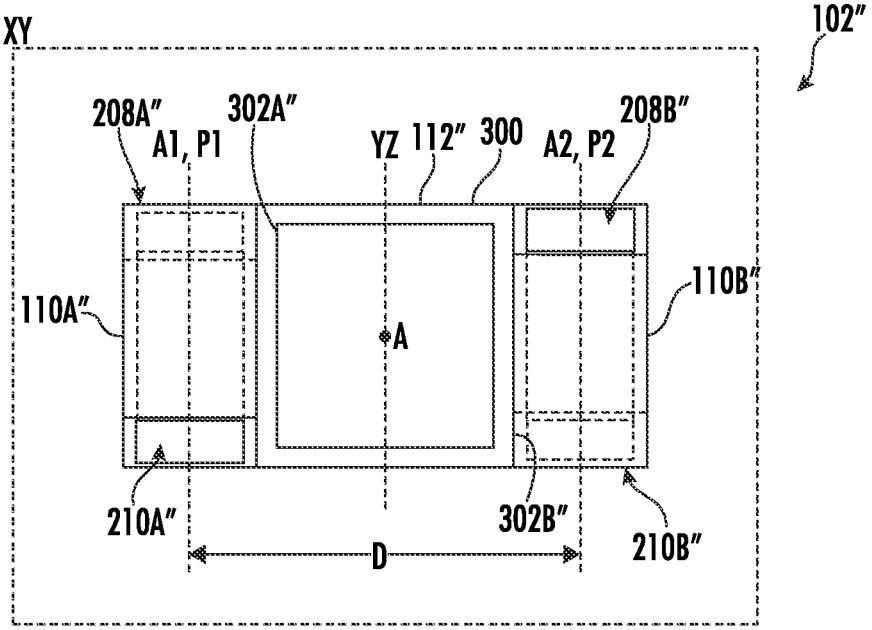
FIG. 3D is a front view of the pile connection of FIG. 3A.
Figure 3E:
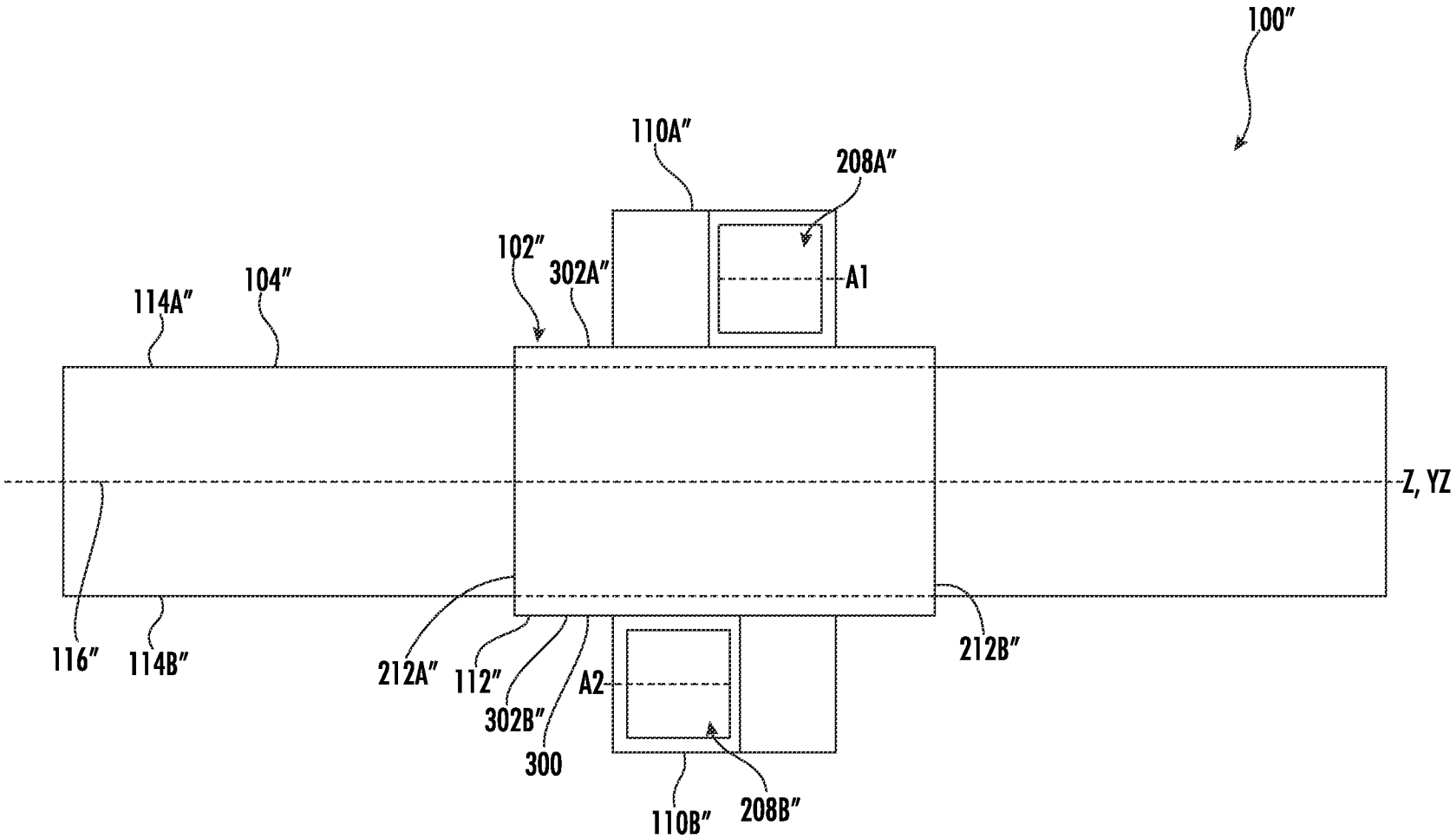
FIG. 3E is a top view of the pile connection of FIG. 3A.
Figure 4A:
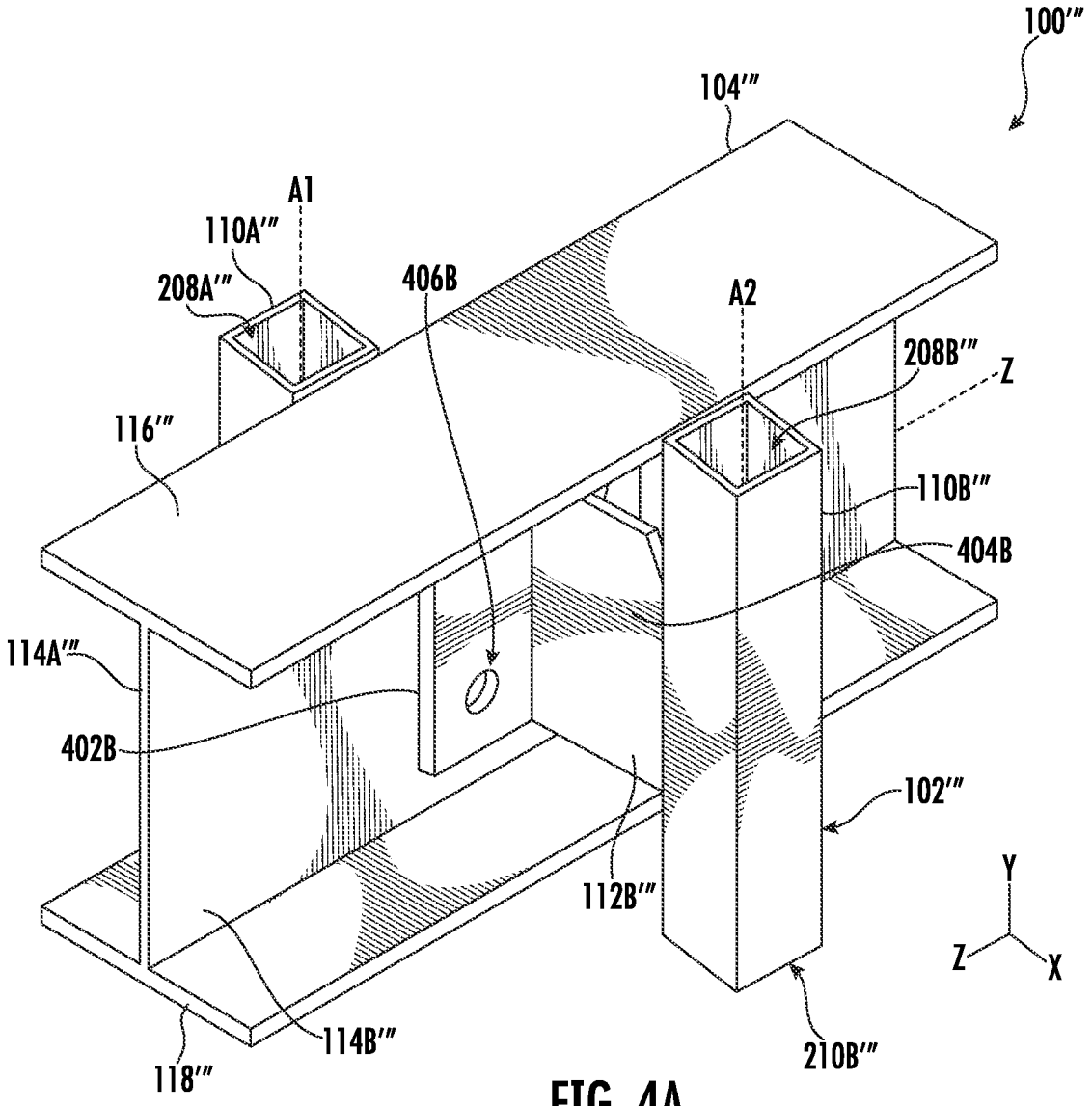
FIG. 4A is a perspective view of another embodiment of the pile connection of FIG. 1A for attachment to an elongated I-beam.
Figure 4B:
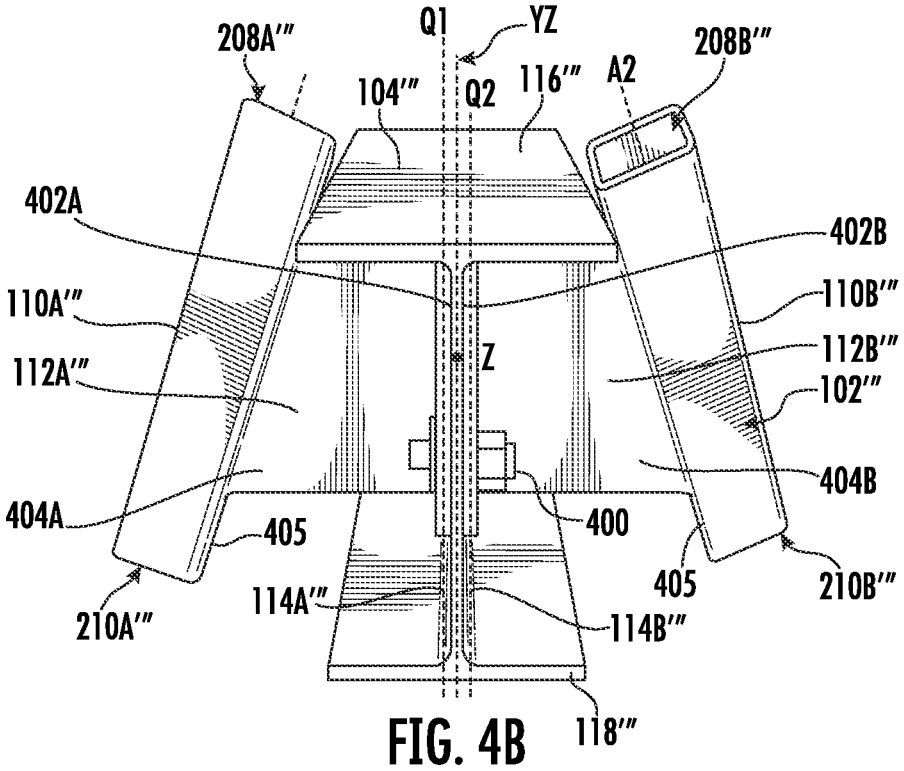
FIG. 4B is an assembled perspective view of the pile connection of FIG. 4A.
Figure 4C:
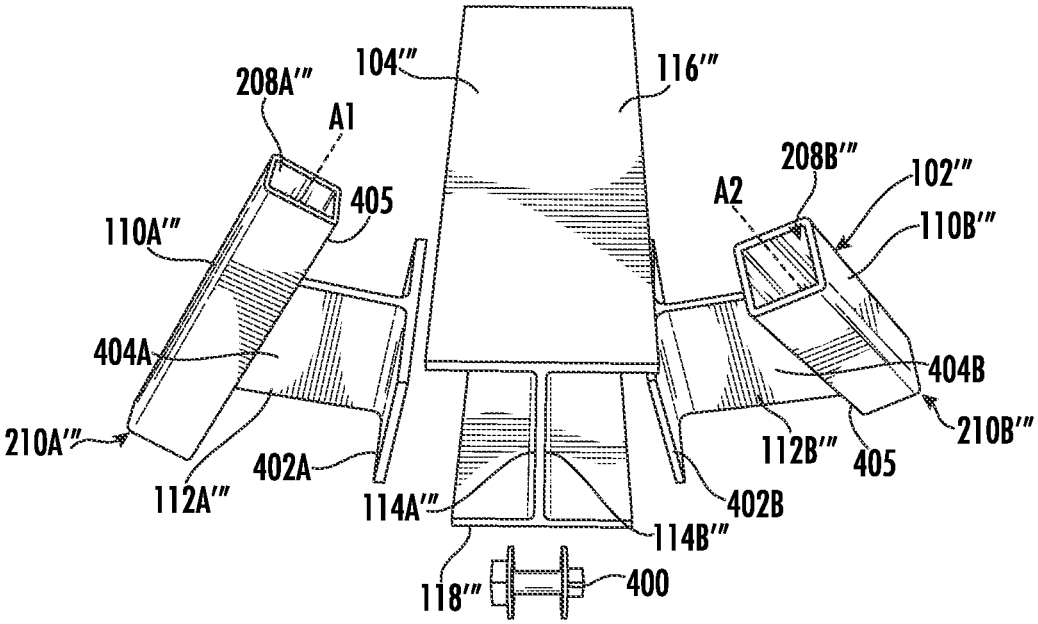
FIG. 4C is an exploded perspective view of the pile connection of FIG. 4A.
Figure 4D:
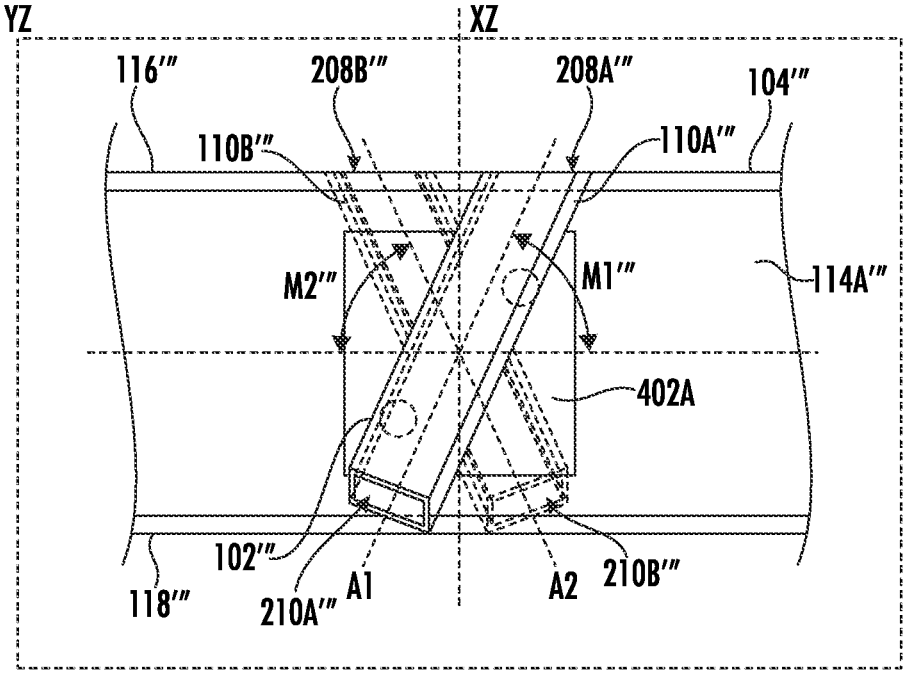
FIG. 4D is a side view of the pile connection of FIG. 4A.
Figure 4E:
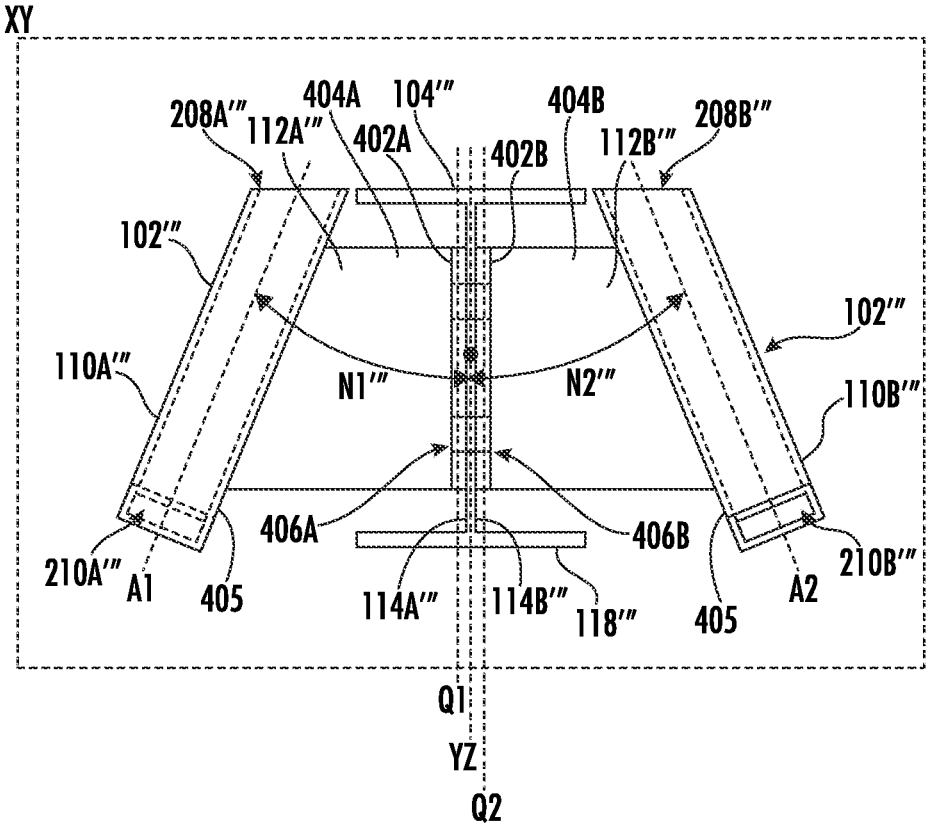
FIG. 4E is a front view of the pile connection of FIG. 4A.
Figure 4F:
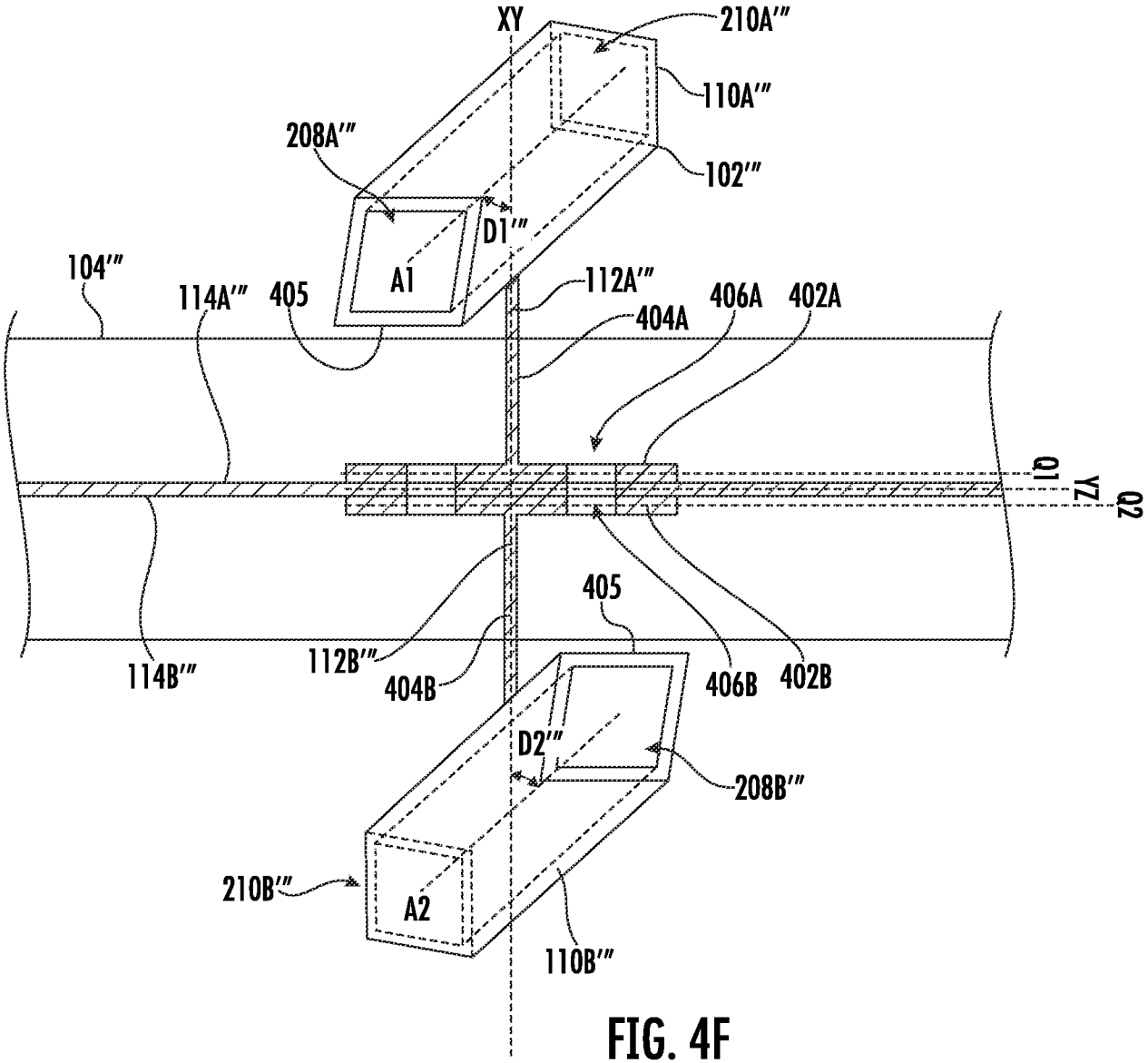
FIG. 4F is a top view of the pile connection of FIG. 4A.

FIGS. 3A-3B are views of another embodiment of the pile connection 102 of FIG. 1A for attachment to an elongated beam 104" with a square cross-section. In particular, a foundation support system 100" includes at least one pile connection 102" horizontally fixing the elongated beam 104" to the ground 106. The elongated beam 104" has a square cross-section.

The at least one pile connection 102" is attached to the at least one elongated beam 104". The at least one pile connection 102" includes a first pile sleeve 110A", a second pile sleeve 110B", and at least one coupling 112" configured to attach the first pile sleeve 110A" and the second pile sleeve 110B" to the elongated beam 104".

The coupling 112" attaches the first pile sleeve 110A" to the elongated beam 104" at a first side 114A" of the elongated beam 104" such that a first pile 108A within the first pile sleeve 110A" extends between a top 116" and a bottom 118" of the elongated beam 104". The coupling 112" attaches the second pile sleeve 110B" to the elongated beam 104" at a second side 114B" of the elongated beam 104" such that a second pile 108B within the second pile sleeve 110B" extends between the top 116" and the bottom 118" of the elongated beam 104". In particular, the coupling 112" includes a collar 300 having a rectangular cross-section. In certain embodiments, the coupling 112" includes a weld attaching the first and second pile sleeves 110A", 110B" to the collar 300.

In certain embodiments, the first pile sleeve 110A" and the second pile sleeve 110B" are attached to opposite sides 302A", 302B" of the collar 300. The first pile sleeve 110A" extends in a first plane P1, and the second pile sleeve 110B" extends in a second plane P2 parallel to and offset from the first plane P1. In other words, the first plane P1 and the second plate P2 are parallel to the axis Z (and plane YZ) of the elongated beam 104". The first pile sleeve 110A" is attached to a first side of the collar 300, and the second pile sleeve 110B" is attached to a second side of the collar 300. The first pile sleeve 110A" and the second pile sleeve 110B" extends from a top of the collar 300 to a bottom of the collar 300. The first pile sleeve 110A" and the second pile sleeve 110B" each includes a rectangular cross-section, such as to receive a pile having a rectangular cross-section.

The collar includes a first end 212A" and a second end 212B" opposite the first end 212A". A top opening 208A" of the first pile sleeve 110A" is angled toward the second end 212B" of the collar 300, and a bottom opening 210A" of the first pile sleeve 110A" is angled toward the first end 212A" of the collar 300. A top opening 208B" of the second pile sleeve 110B" is angled toward the first end 212A" of the collar 300, and a bottom opening 210B" of the second pile sleeve 110B" is angled toward the second end 212B" of the collar 300. A distance D between the top openings 208A" of the pile sleeves 110A", 110B" is generally the same as a distance D between the bottom openings 210A", 210B" of the pile sleeves 110A", 110B". In this way, the piles are inserted into the ground in opposing directions to improve stability.

FIGS. 4A-4F are views of another embodiment of the pile connection 102 of FIG. 1A for attachment to an elongated beam 104". In particular, a foundation support system 100'" includes at least one pile connection 102'" horizontally fixing the elongated beam 104'" to the ground. The elongated beam 104'" is an I-beam. In certain embodiments, the elongated beam could include timber (e.g., rectangular cross-section, square cross-section, etc.).

The at least one pile connection 102'" is attached to the at least one elongated beam 104'". The at least one pile connection 102'" includes a first pile sleeve 110A'", a second pile sleeve 110B'", and at least one coupling 112A'", 112B'" configured to attach the first pile sleeve 110A'" and the second pile sleeve 110B'" to the elongated beam 104".

The at least one coupling 112A'", 112B'" includes a first coupling 112A'" configured to be positioned at a first side 114A'" of the elongated beam 104'", a second coupling 112B'" configured to be positioned at a second side 114B'" of the elongated beam 104'", and at least one fastener 400 configured to extend through the elongated beam 104'" to attach the first coupling 112A'" and the second coupling 112B'" to the elongated beam 104".

The first coupling 112A'" includes a first mounting plate 402A and a first arm 404A (perpendicularly) extending from the first mounting plate 402A and attached to a side 405 of the first pile sleeve 110A'" such that a first axis A1 of the first pile sleeve 110A'" is non-parallel to a first plane Q1 defined by the first mounting plate 402A. The first mounting plate 402A defines at least one first through-hole 406A.

The second coupling 112B'" includes a second mounting plate 402B and a second arm 404B (perpendicularly) extending from the second mounting plate 402B and attached to a side of the second pile sleeve 110B'" such that a second axis A1 of the second pile sleeve 110B'" is non-parallel to a second plane Q2 defined by the second mounting plate 402B. The second mounting plate 402B, defines at least one second through-hole 406B.

From perspective of plane YZ, the axis A1 of the first pile sleeve 110A is at an angle M1'" greater than 90° from the Z-axis, and the axis B2 of the second pile sleeve 110B is at an angle M2'" greater than 90° from the Z-axis. In certain embodiments, the angle M1'" and angle M2'" are substantially the same. From perspective of plane XY, the axis A1 of the first pile sleeve 110A is at an angle N1'" less than 90° from a YZ plane, and the axis B2 of the second pile sleeve 110B is at an angle N2'" less than 90° from the YZ plane. In certain embodiments, the angle N1'" and angle N2'" are substantially the same. From perspective of plane XZ, the axis A1 of the first pile sleeve 110A is at an angle O1'" greater than 90° from an XY plane (intersecting the arms 404A, 404B), and the axis B2 of the second pile sleeve 110B is at an angle O2'" greater than 90° from the XY plane. In certain embodiments, the angle O1' and angle O2'" are substantially the same.

The at least one fastener 400 is configured to extend through the at least one first through-hole 406A of the first mounting plate 402A, the elongated beam 104'", and the at least one second through-hole 406B of the second mounting plate 402B.

Figure 5A:
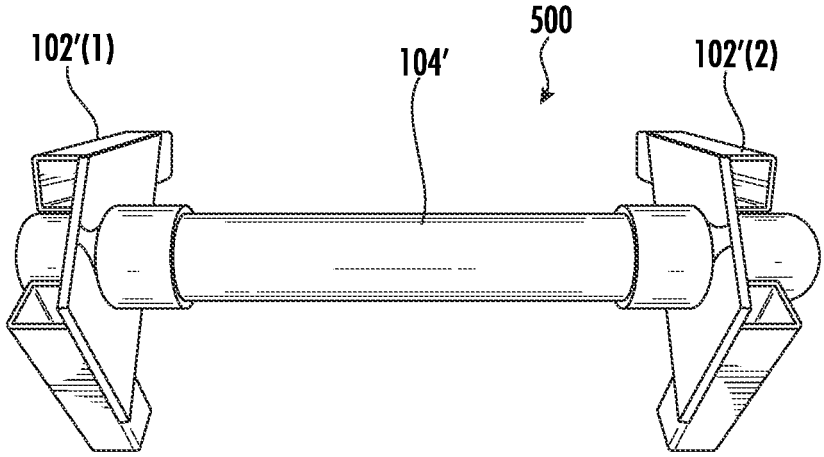
FIG. 5A is a top view of a foundation support system including two pile connections of FIGS. 2A-2E mounted to an elongated beam.
Figure 5B:
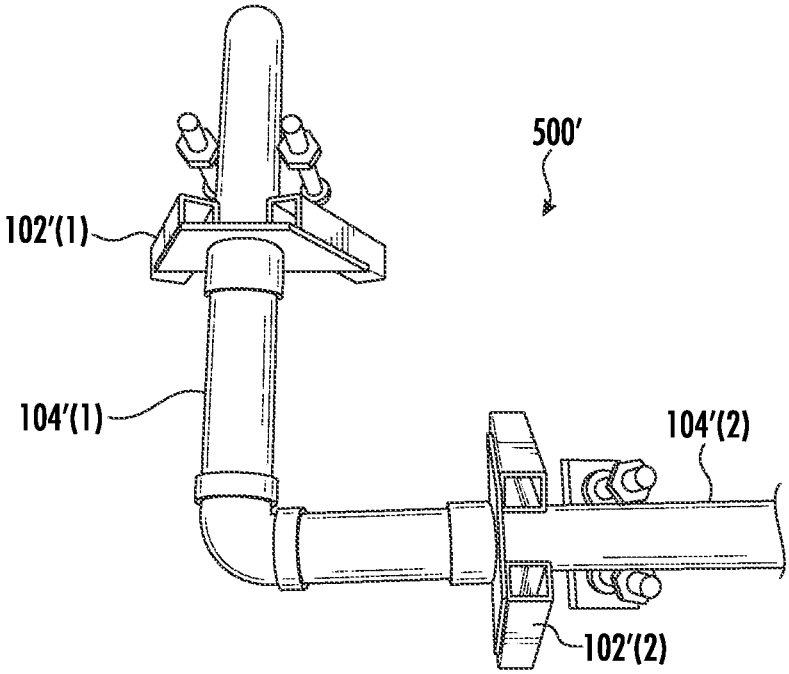
FIG. 5B is a top view of a foundation support system including two pile connections of FIGS. 2A-2E mounted to elongated beams attached at an angle to one another.

FIGS. 5A-5B are views of a foundation support system including two pile connections 102'(1), 102'(2) (referred to generally as pile connections 102'). In particular, FIG. 5A is a top view of a foundation support system 500, including two pile connections 102'(1), 102'(2) of FIGS. 2A-2E mounted to the elongated beam 104' of FIGS. 2A-2E. FIG. 5B is a top view of a foundation support system 500' including two pile connections 102'(1), 102'(2) of FIGS. 2A-2E mounted to the elongated beams 104'(1), 104'(2) of FIGS. 2A-2E attached at an angle to one another. Accordingly, the pile connections 102'(1), 102'(2) may be mounted at a variety of locations of the elongated beam 104' and to a variety of different types of elongated beam assemblies. In other words, the pile connections 102'(1), 102'(2) are modular and/or scalable.

Figure 6A:
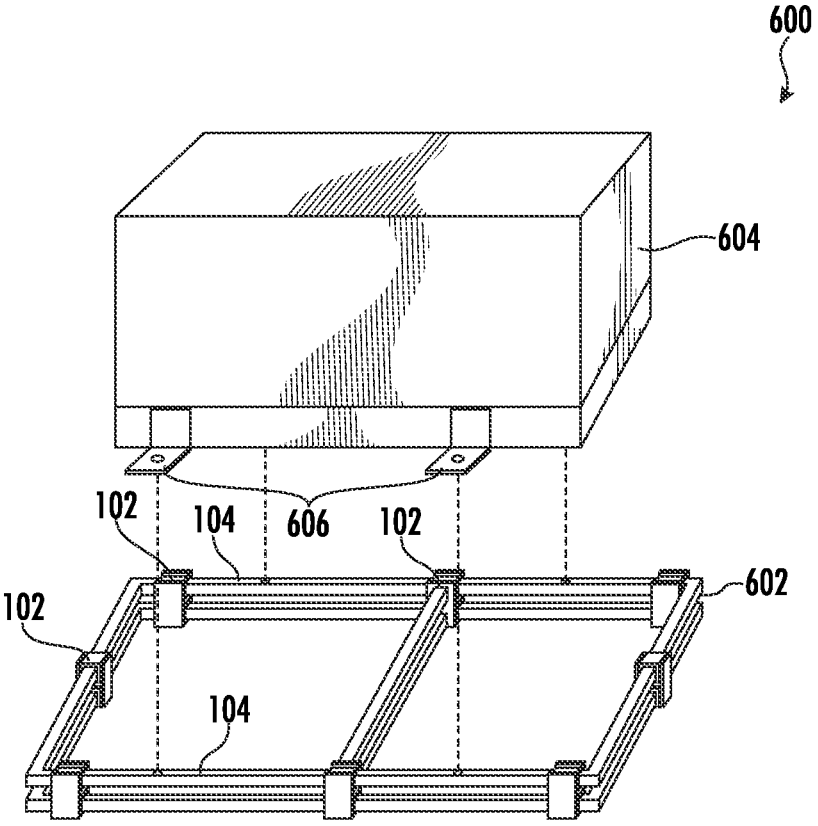
FIG. 6A is a view of a foundation support system including elongated beams forming a frame, pile connections of FIGS. 1A-1B mounted to the elongated beams, and a container attached to the frame by brackets.
Figure 6B:
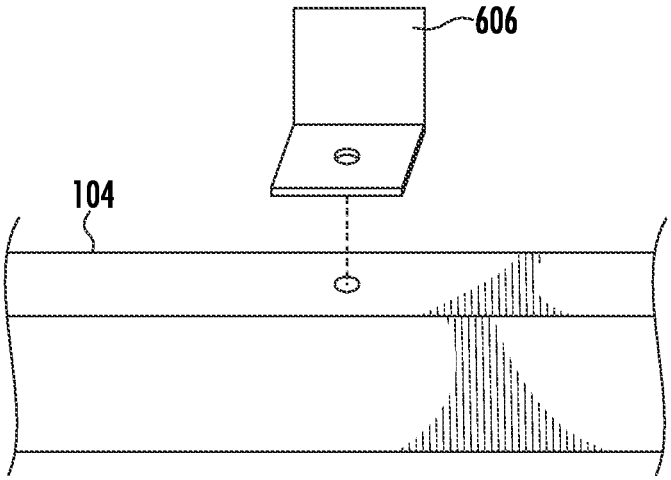
FIG. 6B is a close up view of a portion of the foundation support system of FIG. 6A.

FIGS. 6A-6B are views of a foundation support system 600, including elongated beams 104 forming a frame 602, the pile connections 102 of FIGS. 1A-1B mounted to the elongated beams 104, and a container 604 attached to the frame 602 by brackets 606. Multiple pile connections 102 may be attached to the same elongated beam 104. Further, some pile connections 102 may include one or two pile sleeves 110. In this way, two pile connections 102 may be attached to one elongated beam 104 with one pile sleeve 110 positioned on one side of the elongated beam 104 and another pile sleeve 110 positioned on the opposite side of the elongated beam 104.

Many containers 604 (may also be referred to as a containment structure) include commercial-scale generators, air handlers, pumps, load banks, or inverters. In certain embodiments, the container 604 includes an internal frame. The brackets 606 or holes are predrilled in the internal frames to mount the container 604 to the frame 602 (instead of a concrete pad) to minimize potential movement from vibration or outside forces. Unlike concrete slabs, the frame 602 may be less expensive to set up and remove (e.g., upon completion of a project). It is noted that although the container 604 is shown, other structures could use the pile connections 102 and/or frame 602.

Figure 7A:
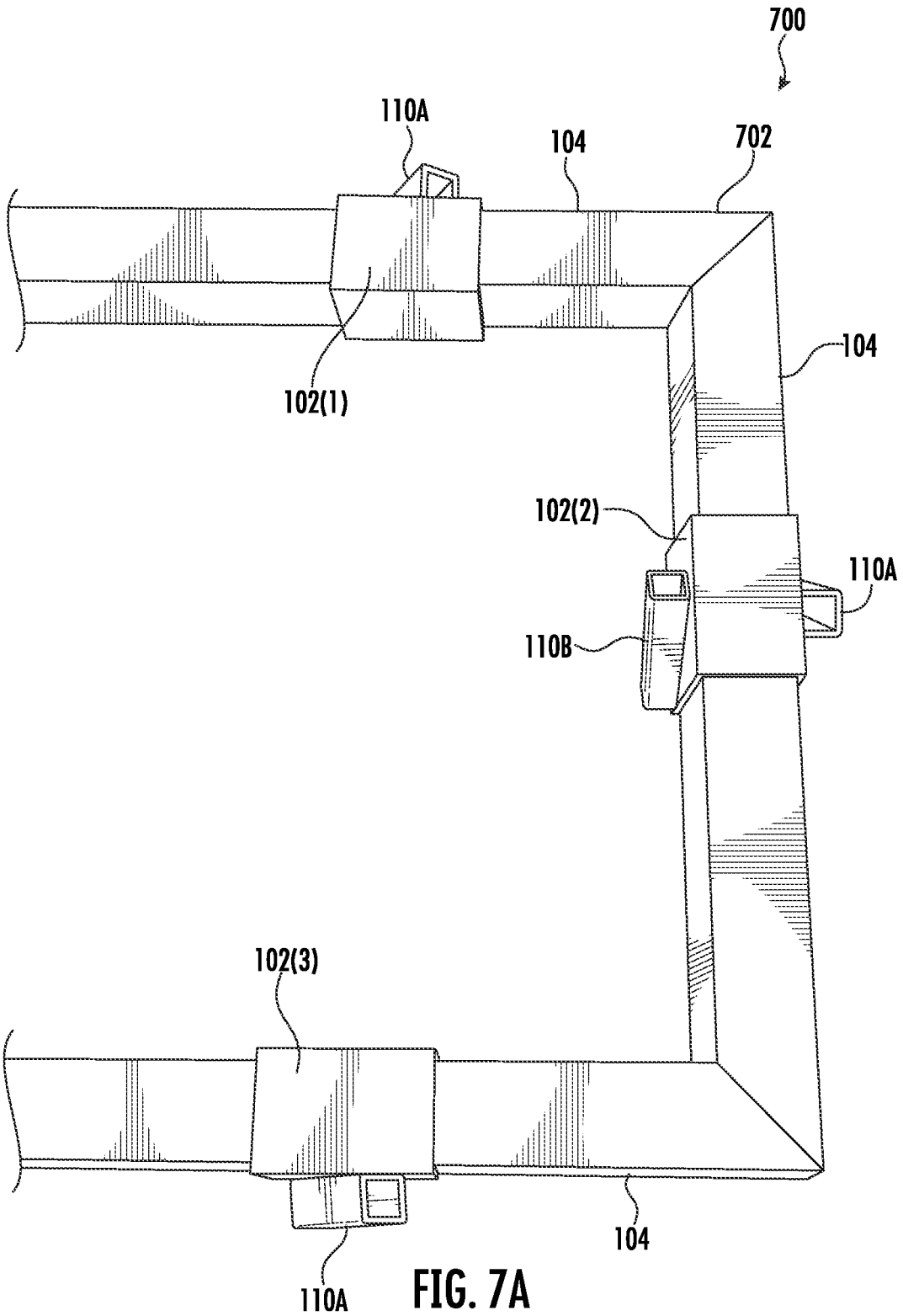
FIG. 7A is a view of one embodiment of the foundation support system of FIG. 6A-6B.
Figure 7B:
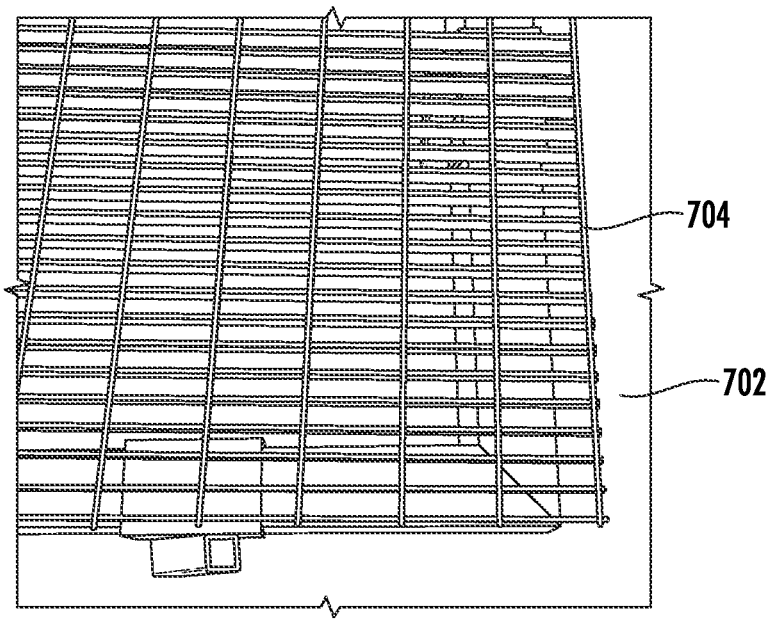
FIG. 7B is a view of one embodiment of a grate attached to the frame of FIG. 7A.
Figure 7C:
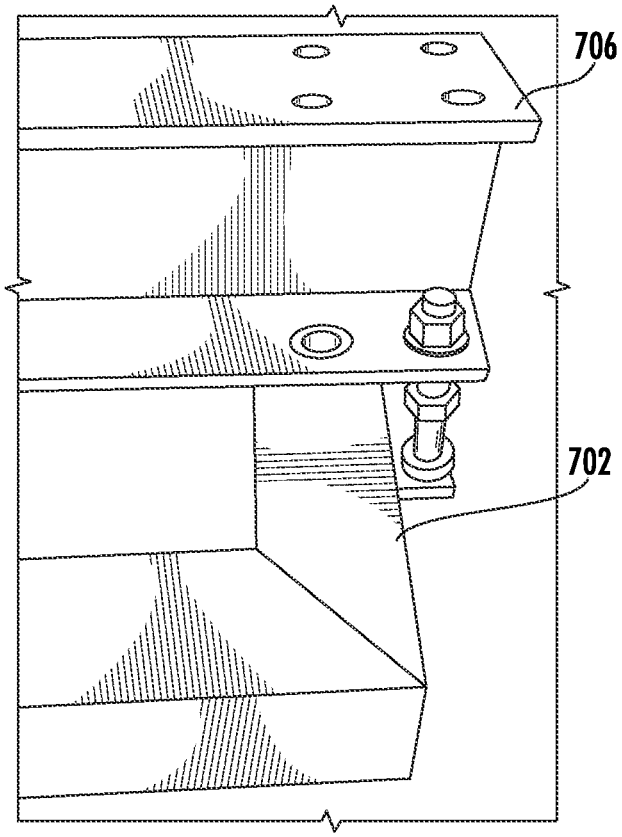
FIG. 7C is a view of one embodiment of an I-beam attached to the frame of FIG. 7A.
Figure 7D:
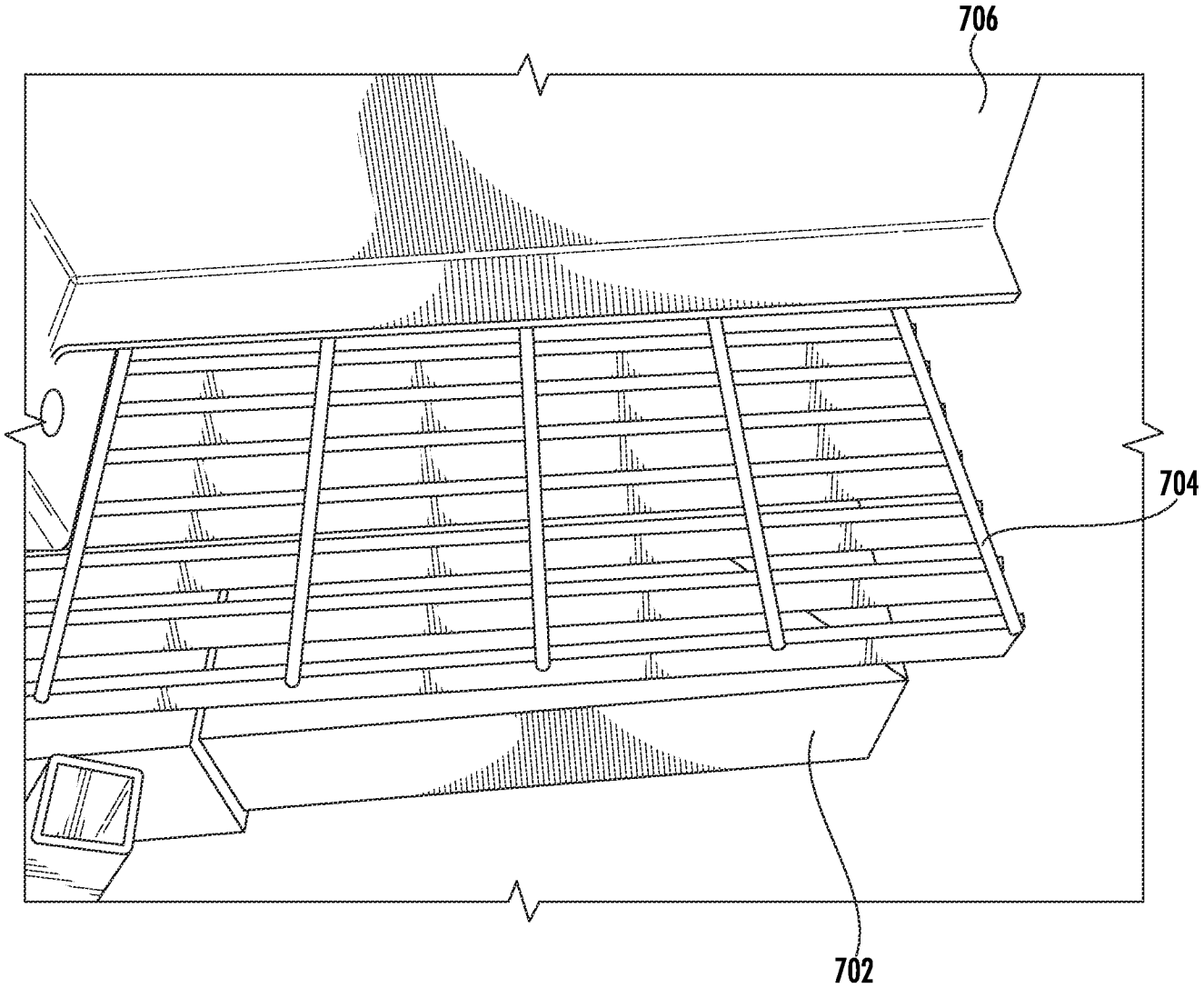
FIG. 7D is a view of one embodiment of a grate and an I-beam attached to the frame of FIG. 7A.

FIGS. 7A-7D are views of an embodiment of the foundation support system 700 of FIGS. 6A-6B. In particular, FIG. 7A is a view of one embodiment of the foundation support system of FIGS. 6A-6B, including the frame 702 (including a plurality of elongated beams 104). As noted above, pile connection 102(2) includes two pile sleeves 110A, 110B, and pile connections 102(1), 102(3) include a single pile sleeve 110A. FIG. 7B is a view of one embodiment of a grate 704 attached to the frame 702 of FIG. 7A. FIG. 7C is a view of one embodiment of an I-beam 706 attached to the frame 702 of FIG. 7A. FIG. 7D is a view of one embodiment of a grate 704 and an I-beam 706 attached to the frame 702 of FIG. 7A. The grates 700, I-beams 702, and/or other structures may be attached to the foundation support system using a variety of fasteners. For example, in certain embodiments, the fastener may include a girder clamp, holl-bolt, lindbolt, decking fixing (e.g., type MF), support fixing (e.g., type FL, LC, FLS, SW, F3, SH, etc.), floor fixings (e.g., type GF grate-fast), and/or rail fixing (e.g., type BR rail clip, type HD soft clip, type HD spring clip, etc.), etc.

Figure 8:
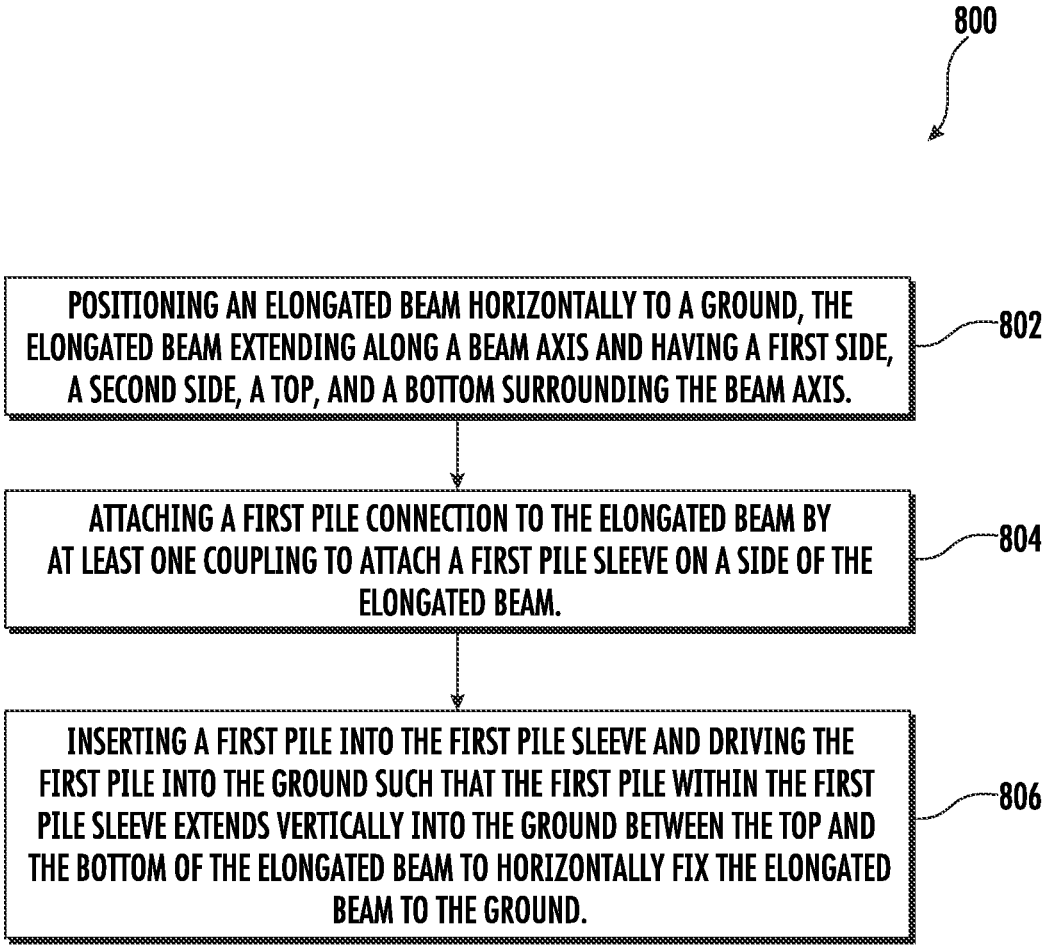
FIG. 8 is a flowchart illustrating a method for forming a foundation support system.

FIG. 8 is a flowchart 800 illustrating a method for forming a foundation support system. Step 802 includes positioning an elongated beam 104, 104', 104", 104'" (referred to generally as elongated beam 104) horizontally to a ground, the elongated beam 104 extending along a beam axis Z and having a first side 114A, 114A', 114A", 114A'" (referred to generally as a first side 114A), a second side 114B, 114B', 114B", 114B'" (referred to generally as a second side 114B), a top 116, 116', 116" (referred to generally as a top 116), and a bottom 118, 118', 118" (referred to generally as a bottom 118) surrounding the beam axis Z.

Step 804 includes attaching a first pile connection 114A, 114A', 114A", 114A'" (referred to generally as a first pile connection 114A) to the elongated beam 104 by at least one coupling 112, 112', 112", 112'" (referred to generally as a coupling 112) to attach a first pile sleeve 110A, 110A', 110A", 110A'" (referred to generally as a first pile sleeve 110A) on a side 114A of the elongated beam 104. In certain embodiments, attaching the first pile connection 114A to the elongated beam 104 by the at least one coupling 112 further includes attaching the first pile connection 114A to the elongated beam 104 by at least one coupling 112 to attach the first pile sleeve 110A and a second pile sleeve 110B, 110B', 110B", 110B'" (referred to generally as a second pile sleeve 110B) on opposing sides 114A, 114B of the elongated beam 104.

Step 806 includes inserting a first pile 108A into the first pile sleeve 110A and driving the first pile 108A into the ground 106 such that the first pile 108A within the first pile sleeve 110A extends vertically into the ground 106 between the top 116 and the bottom 118 of the elongated beam 104 to horizontally fix the elongated beam 104 to the ground 106.

In certain embodiments, the method further includes inserting a second pile 108B into the second pile sleeve 110B and driving the second pile 108B into the ground 106 such that the second pile 108B within the second pile sleeve 110B extends vertically into the ground 106 between a top 116 and a bottom 118 of the elongated beam 104 to horizontally fix the elongated beam 104 to the ground 106.

In certain embodiments, the method further includes attaching a second pile connection 114B to the elongated beam 104.

It will be apparent to those skilled in the art that various modifications and variations can be made without departing from the spirit or scope of the invention.

Many modifications and other embodiments of the embodiments set forth herein will come to mind to one skilled in the art to which the embodiments pertain having the benefit of the teachings presented in the foregoing descriptions and the associated drawings. Therefore, it is to be understood that the description and claims are not to be limited to the specific embodiments disclosed and that modifications and other embodiments are intended to be included within the scope of the appended claims. It is intended that the embodiments cover the modifications and variations of the embodiments, provided they come within the scope of the appended claims and their equivalents. Although specific terms are employed herein, they are used in a generic and descriptive sense only and not for purposes of limitation.

What is claimed is:

1. A pile connection for horizontally fixing an elongated beam to a ground, comprising:

a first pile sleeve configured to receive a first pile and guide passage of the first pile to permit the first pile to be driven into the ground;

at least one coupling configured to attach the first pile sleeve to an elongated beam extending horizontally relative to the ground along a beam axis and having a first side, a second side, a top, and a bottom surrounding the beam axis; and wherein the at least one coupling is configured to attach the first pile sleeve to the elongated beam at the first side of the elongated beam such that the first pile, when received by the first pile sleeve, extends between the top and the bottom of the elongated beam.

2. The pile connection of claim 1, further comprising a second pile sleeve configured to receive a second pile and guide passage of the second pile to permit the second pile to be driven into the ground;

wherein the at least one coupling is configured to attach the second pile sleeve to the elongated beam; and wherein the at least one coupling is configured to attach the second pile sleeve to the elongated beam at the second side of the elongated beam such that the second pile, when received by the second pile sleeve extends between the top and the bottom of the elongated beam.

3. The pile connection of claim 2, wherein:

the at least one coupling comprises a mounting plate and a collar perpendicularly attached to the mounting plate at a first side of the mounting plate, the mounting plate comprising a trapezoidal shape, the collar comprising a cylindrical sidewall having a circular cross-section and defining a side hole in the cylindrical sidewall for setting an orientation of the collar about the elongated beam;

the first pile sleeve and the second pile sleeve are attached at a second side of the mounting plate, the first pile sleeve and the second pile sleeve each having a rectangular cross-section;

the first pile sleeve and the second pile sleeve are aligned within a common plane such that a top horizontal distance between tops of the first pile sleeve and the second pile sleeve is smaller than a bottom horizontal distance between bottoms of the first pile sleeve and the second pile sleeve; and wherein the first pile sleeve and the second pile sleeve are configured to extend from a top of the collar to a bottom of the collar.

4. The pile connection of claim 2, wherein:

the at least one coupling comprises a collar having a rectangular cross-section;

the first pile sleeve is attached to a first side of the collar, and the second pile sleeve is attached to a second side of the collar;

the first pile sleeve extends in a first plane, and the second pile sleeve extends in a second plane parallel to and offset from the first plane; and the first pile sleeve and the second pile sleeve extend from a top of the collar to a bottom of the collar.

5. The pile connection of claim 2, wherein:

the at least one coupling comprises a first coupling configured to be positioned at the first side of the elongated beam, a second coupling configured to be positioned to the second side of the elongated beam, and at least one fastener configured to extend through the elongated beam to attach the first coupling and the second coupling to the elongated beam;

the first coupling comprises a first mounting plate and a first arm perpendicularly extending from the first mounting plate and attached to a side of the first pile sleeve such that a first axis of the first pile sleeve is non-parallel to a first plane defined by the first mounting plate, the first mounting plate defining at least one first through-hole;

the second coupling comprises a second mounting plate and a second arm perpendicularly extending from the second mounting plate and attached to a side of the second pile sleeve such that a second axis of the second pile sleeve is non-parallel to a second plane defined by the second mounting plate, the second mounting plate defining at least one second through-hole; and the at least one fastener is configured to extend through the at least one first through-hole of the first mounting plate, the elongated beam, and the at least one second through-hole of the second mounting plate.

6. The pile connection of claim 2, wherein the pile connection comprises only two pile sleeves.

7. The pile connection of claim 2, wherein the first pile sleeve and the second pile sleeve each comprise a rectangular cross-section.

8. The pile connection of claim 2, wherein the first pile sleeve and the second pile sleeve are non-parallel to each other.

9. The pile connection of claim 8, wherein the first pile sleeve and the second pile sleeve are aligned in a common plane.

10. The pile connection of claim 8, wherein the first pile sleeve extends in a first plane, and the second pile sleeve extends in a second plane parallel to and offset from the first plane.

11. The pile connection of claim 8, wherein the first pile sleeve extends in a first plane, and the second pile sleeve extends in a second plane non-parallel to and offset from the first plane.

12. The pile connection of claim 2, wherein the at least one coupling comprises a collar comprising at least one of a circular cross-section, a rectangular cross-section, or a square cross-section.

13. The pile connection of claim 12, wherein the first pile sleeve and the second pile sleeve are attached to opposite sides of the collar.

14. The pile connection of claim 12, wherein the at least one coupling further comprises a mounting plate perpendicularly attached to an end of the collar, the first pile sleeve, and the second pile sleeve attached to the mounting plate.

15. The pile connection of claim 2, wherein the at least one coupling comprises a first coupling configured to be positioned at the first side of the elongated beam, a second coupling configured to be positioned to the second side of the elongated beam, and at least one fastener configured to extend through the elongated beam to attach the first coupling and the second coupling to the elongated beam;

the first coupling comprises a first mounting plate and a first arm extending from the first mounting plate and attached to a side of the first pile sleeve; and the second coupling comprises a second mounting plate and a second arm extending from the second mounting plate and attached to a side of the second pile sleeve.

16. A foundation support system, comprising:

at least one elongated beam extending horizontally relative to a ground along a beam axis and having a first side, a second side, a top, and a bottom surrounding the beam axis; and at least one pile connection attached to the at least one elongated beam, the at least one pile connection comprising:

a first pile sleeve and a first pile received by the first pile sleeve, the first pile sleeve being configured to guide passage of the first pile to permit the first pile to be driven into the ground; and at least one coupling configured to attach the first pile sleeve to the elongated beam;

wherein the at least one coupling attaches the first pile sleeve to the elongated beam at the first side of the elongated beam such that the first pile received by the first pile sleeve extends between the top and the bottom of the elongated beam.

17. The foundation support system of claim 16, wherein the at least one pile connection further comprises a second pile sleeve;

wherein the at least one coupling is configured to attach the second pile sleeve to the elongated beam;

wherein a second pile is received by the second pile sleeve; and wherein the at least one coupling attaches the second pile sleeve to the elongated beam at the second side of the elongated beam such that the second pile received by the second pile sleeve extends between the top and the bottom of the elongated beam.

18. The foundation support system of claim 16, wherein the elongated beam comprises structural steel.

19. The foundation support system of claim 16, wherein the structural steel comprises circular tubing, rectangular tubing, square tubing, I-Beam, or W-Beam.

20. The foundation support system of claim 16, wherein the at least one pile connection comprises a plurality of pile connections attached to a same one of the at least one elongated beam.

21. The foundation support system of claim 16, wherein the at least one elongated beam comprises a plurality of elongated beams, and the at least one pile connection comprises a plurality of pile connections to fix the plurality of elongated beams to the ground.

22. A method for forming a foundation support system, the method comprising:

positioning an elongated beam horizontally relative to a ground, the elongated beam extending along a beam axis and having a first side, a second side, a top, and a bottom surrounding the beam axis;

attaching a first pile connection to the elongated beam by at least one coupling to attach a first pile sleeve on a side of the elongated beam; and inserting a first pile into the first pile sleeve and driving the first pile into the ground such that the first pile received by the first pile sleeve extends vertically into the ground between the top and the bottom of the elongated beam, with the elongated beam positioned horizontally relative to the ground, to horizontally fix the elongated beam to the ground.

23. The method of claim 22, wherein attaching the first pile connection to the elongated beam by at least one coupling further includes attaching the first pile connection to the elongated beam by at least one coupling to attach the first pile sleeve and a second pile sleeve on opposing sides of the elongated beam; and wherein the method further comprises inserting a second pile into the second pile sleeve and driving the second pile into the ground such that the second pile received by the second pile sleeve extends vertically into the ground between the top and the bottom of the elongated beam to horizontally fix the elongated beam to the ground.

24. The method of claim 22, further comprising attaching a second pile connection to the elongated beam.

* * * * *